US012123670B1

(12) United States Patent
Hoffman et al.

(10) Patent No.: US 12,123,670 B1
(45) Date of Patent: Oct. 22, 2024

(54) COMBAT OPTIMIZED BALLISTIC REMOTE ARMAMENT WITH SAFETY FEATURE

(71) Applicant: U.S. Government as Represented by the Secretary of the Army, Dover, NJ (US)

(72) Inventors: Brian Hoffman, Bloomington, IN (US); Alex Smith, Long Valley, NJ (US); Michael Colonnello, Mine Hill, NJ (US); Eric Binter, Sussex, NJ (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 0 days.

(21) Appl. No.: 18/486,303

(22) Filed: Oct. 13, 2023

Related U.S. Application Data

(63) Continuation of application No. 17/155,457, filed on Jan. 22, 2021, now Pat. No. 11,835,312.

(51) Int. Cl.

| | |
|---|---|
| ***F41A 9/34*** | (2006.01) |
| ***F41A 7/06*** | (2006.01) |
| ***F41A 9/37*** | (2006.01) |
| ***F41A 17/42*** | (2006.01) |
| ***F41A 19/08*** | (2006.01) |
| ***F41A 19/12*** | (2006.01) |
| ***F41A 19/58*** | (2006.01) |
| ***F41A 25/00*** | (2006.01) |
| ***F41A 25/14*** | (2006.01) |
| ***F41A 27/00*** | (2006.01) |

(52) U.S. Cl.
CPC ..... *F41A 19/08* (2013.01); *F41A 7/06* (2013.01); *F41A 9/34* (2013.01); *F41A 9/37* (2013.01); *F41A 17/42* (2013.01); *F41A 19/12* (2013.01); *F41A 19/58* (2013.01); *F41A 25/00* (2013.01); *F41A 25/14* (2013.01); *F41A 27/00* (2013.01)

(58) Field of Classification Search
CPC ..... F41A 25/00; F41A 27/00; F41A 17/42; F41A 17/64; F41A 17/00–82; F41A 23/00–60; F41G 5/00–26
See application file for complete search history.

(56) References Cited

U.S. PATENT DOCUMENTS 2,368,307 A * 1/1945 Koonz ..... F41A 19/59 89/135
2,429,204 A * 10/1947 Gunner ..... F41A 19/31 89/27.11
2,831,402 A 4/1958 Norman
(Continued)

FOREIGN PATENT DOCUMENTS

DE 2403477 A * 7/1975 ..... F41A 17/06
EP 1353138 A1 * 10/2003 ..... F41A 17/06
(Continued)

*Primary Examiner* — Gabriel J. Klein
(74) *Attorney, Agent, or Firm* — John P. DiScala

(57) ABSTRACT

A remote weapon system (RWS) for an unmanned ground vehicle (UGV) includes a dedicated weapon, multi-axis gimbal and ammunition handling capabilities with all operations functioning remotely and wirelessly. The RWS comprises system-level and component-level safety features which preclude the weapon of the remote weapon system from being operable if removed from the remote weapon system.

6 Claims, 26 Drawing Sheets

(56) References Cited

U.S. PATENT DOCUMENTS 3,802,313 A * 4/1974 Rocha ..... F41A 3/82 89/198
4,730,537 A * 3/1988 Matzagg ..... F41A 17/64 42/70.08
4,966,063 A * 10/1990 Sanderson ..... F41A 23/00 89/44.01
5,949,015 A 9/1999 Smith
6,286,411 B1 * 9/2001 Sanderson ..... B64D 7/02 89/37.14
7,543,524 B1 * 6/2009 Javorsky ..... F41A 9/60 89/37.11
7,963,205 B1 * 6/2011 Brooks ..... F41A 27/14 89/37.03
8,033,207 B1 * 10/2011 Smith ..... F41A 15/14 42/84
10,890,407 B1 * 1/2021 Archer ..... F41G 5/14
2004/0134340 A1 * 7/2004 Quinn ..... F41G 3/06 89/41.01
2007/0119296 A1 * 5/2007 Niv ..... F41A 23/20 89/37.02
2007/0261544 A1 * 11/2007 Philippe ..... F41A 23/24 89/41.05
2008/0148931 A1 6/2008 Svensson
2015/0330735 A1 * 11/2015 Yamin ..... F41A 17/58 89/150
2016/0258704 A1 * 9/2016 Hobson ..... F41A 27/28

FOREIGN PATENT DOCUMENTS

EP 1508765 2/2005
EP 2216616 A2 * 8/2010 ..... F41A 17/06
KR 20070090553 A * 9/2007
WO WO-2014102771 A1 * 7/2014 ..... F41A 17/06

* cited by examiner

COMBAT OPTIMIZED BALLISTIC REMOTE ARMAMENT WITH SAFETY FEATURE

CROSS-REFERENCE TO RELATED APPLICATIONS

This application is a continuation of U.S. utility patent application Ser. No. 17/155,457 filed on Jan. 22, 2021.

STATEMENT OF GOVERNMENT INTEREST

The inventions described herein may be manufactured, used and licensed by or for the United States Government.

FIELD OF THE INVENTION

The invention relates in general to remotely operated weapons.

BACKGROUND OF THE INVENTION

Small unmanned ground vehicles (UGV) and small unmanned aerial systems (UAS) are beginning to enter the battlefield to the great advantage of the warfighter at the soldier level. Presently, they offer long range reconnaissance, some equipment hauling capability and other soldier-enhancing capabilities. It is anticipated that such systems will also be armed with remote weapon stations (RWS). This will enable soldiers to engage enemies from afar, thereby reducing risk of life in dangerous situations. It will also let the soldier project power beyond line of sight and enable dominance over the entire battlefield.

It is desirable for such an RWS to meet certain requirements imposed by the nature of small UGVs. The system cannot take up too much electric power due to limited on-board battery capacity. The system must have a low profile to maintain a low center of gravity and mitigate tipping of the UGV. It must also be light to minimize power consumption and maximize range. As a truly remote system, the RWS must also be able to autonomously correct some common stoppages and jams with the weapon.

Accordingly a need exists for an RWS which meet these requirements.

SUMMARY OF THE INVENTION

One aspect of the invention is a remote weapon station for use with an unmanned vehicle. The remote weapon station includes a weapon assembly, an active cradle, a multi-axis gimbal and an ammunition magazine. The weapon assembly further comprises a weapon operating group. The active cradle assembly receives the weapon assembly. The multi-axis gimbal is mounted to the unmanned vehicle for supporting and positioning the active cradle to controllably direct fire. The ammunition magazine is mounted to the multi-axis gimbal. The weapon assembly is non-functional when the weapon assembly is separated from the active cradle assembly.

Another aspect of the invention is a remote weapon station for use with an unmanned vehicle. The remote weapon station includes a weapon assembly, an active cradle, a multi-axis gimbal and an ammunition magazine. The weapon assembly further comprises a weapon operating group and a post extending from the interior of the weapon assembly to the exterior of the weapon assembly. The post is biased by a spring to protrude from the exterior of the weapon assembly. The post is sized and dimensioned to mate with a corresponding cavity on the active cradle assembly when the weapon assembly is mounted on the active cradle assembly. The active cradle assembly receives the weapon assembly and further includes a remote charging assembly and a dual feeder assembly. The remote charging assembly interfaces with the weapon operating group to charge the weapon operating group. The dual feeder assembly selectively feeds ammunition from the ammunition magazine into the weapon operating group. The recoil mount receives the weapon assembly and further comprises a cavity sized and dimensioned to receive a portion of the post. The multi-axis gimbal mounted to the unmanned vehicle for supporting and positioning the active cradle to controllably direct fire. The ammunition magazine is mounted on the multi-axis gimbal. Separation of the weapon assembly from the active cradle assembly also separates the weapon operating group from the ammunition handling components. When the weapon assembly is not mounted on the active cradle assembly, the post is positioned such that the post intrudes into the path of the weapon operating group thereby impeding operation of the weapon operating group. When the weapon assembly is mounted on the active cradle assembly, the post is positioned further within the weapon assembly such that a head is aligned with a cut-out in the weapon operating group.

The invention will be better understood, and further objects, features and advantages of the invention will become more apparent from the following description, taken in conjunction with the accompanying drawings.

BRIEF DESCRIPTION OF DRAWINGS

In the drawings, which are not necessarily to scale, like or corresponding parts are denoted by like or corresponding reference numerals.

DETAILED DESCRIPTION OF THE INVENTION

Figure 1:
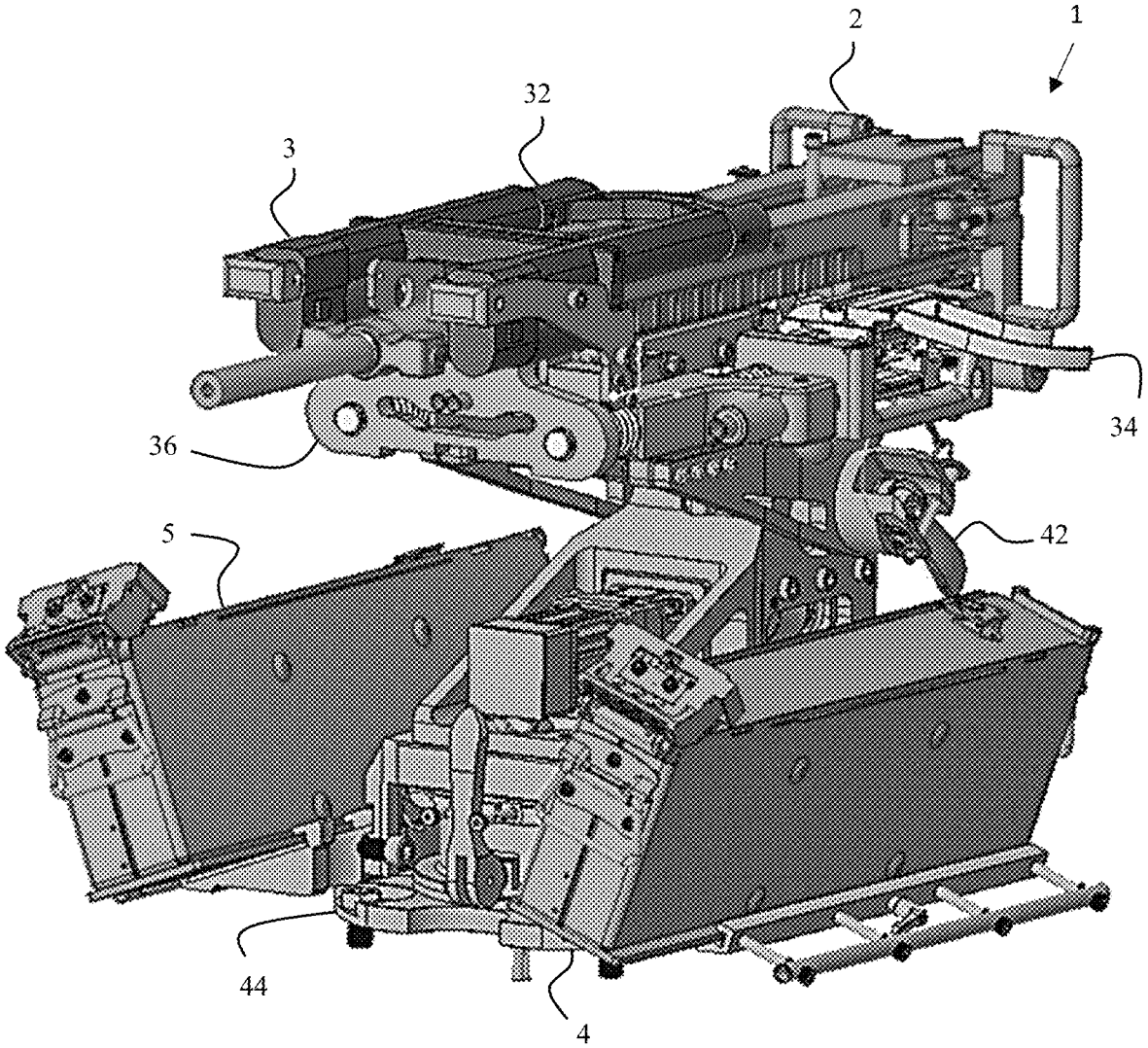
FIG. 1 is a front isometric view of a remote weapon station, according to an illustrative embodiment.

Paragraph with broad description of invention.

A remote weapon station (RWS) 1 system for an unmanned ground vehicle (UGV) includes a dedicated weapon, multi-axis gimbal 4 and ammunition handling capabilities with all operations functioning remotely and wirelessly. The RWS 1 is a gas powered, or self-powered, belt fed, rotating bolt lock weapon.

To increase the utility, the RWS 1 is man-portable and air-droppable to any location where an RWS 1 might exist. To this end, the major subsystems of the RWS 1 were designed to detach from one another and also to retain a degree of modularity to allow for upgrades or other additions to be swapped in and out. The subsystems are: the weapon assembly 2, the remote charging assembly 32, the dual feeder assembly 34, the recoil mount 36, the elevation drive assembly 42, the azimuth drive assembly 44, and two high capacity ammunition magazines 5. The remote charging assembly 32, dual feeder assembly 34 and recoil mount 36 together form the active cradle assembly 3. The elevation drive assembly 42 and azimuth drive assembly 44 together form the multi-axis gimbal 4. The assembly and disassembly of the RWS 1 can be done in the field without the need for tools with only quick latching or disconnecting required. In addition, the electrical connections and other mechanical connections are transparent to the user—they are made simply by the act of locking two subsystems together. There are no external wires or locks to hook up after assembly. The interfaces are all standard mil-spec connections and the locking surfaces are generic to allow for different subsystems to be swapped out. For example, a weapon of a different caliber or one with a single feed option only could be replaced with no change to the rest of the RWS 1. Each subsystem was also designed to weigh 40 pounds or less and be compact enough to fit into individual Storm or Pelican-like mil-spec cases for transport. The entire system can be transported and set up by a single user.

Advantageously, the RWS 1 comprises a hybrid operating system wherein the weapon is gas powered but comprises electronic actuators to charge the weapon and clear jams and obstructions. Using the expanding gas from the propellant to cycle the weapon is common among contemporary machine-guns. This feature is advantageous to a weapon on a small UGV because its limited battery stock does not need to supply the tremendous amount of electrical energy used to cycle most other externally powered guns (EPG) found on remote systems. An EPG does have an advantage, however, in being able to cycle through misfired rounds without hesitation. These and other common jams and stoppages would disable a totally self-powered weapon on a remote vehicle. The RWS 1, however, utilizes a low amount of electrical power for specially designed actuators and sensors to realize the potential of an EPG while eliminating the biggest energy sink, the cycling process. The RWS 1 is actuated and controlled like an EPG but is self-powered. Low power draw linear actuators provide a means to remotely charge the weapon for a first shot, or in the event of a misfire or simple jam. Similarly, a low power draw electric motor actuates a dual feed unit, enabling additional jam resulting from feeding issues. A solenoid operates a trigger to commence firing. Finally, like an EPG, the RWS 1 firing cadence can be precisely controlled for optimal terminal affects, but at no additional expense of electricity which is described below.

The incorporation of the solenoid trigger operation allows the weapon to act very differently than a "dumb" self-powered weapon by enabling a reactive rate of fire control scheme which incorporates feedback from sensors to precisely control rate of fire, burst length, and shot timing. The rate of fire, burst length, and when the round is fired are not dependent on the fixed properties of cartridge impulse, drive spring power and shock absorber parameters. Software is implemented that initiates a shot in vary controlled way. Aiding this is the incorporation of induction proximity sensors, accelerometers, and a linear potentiometer. These simple and reliable low power devices are positioned in the weapon and mount such that a control electronics knows wherein the cycle the gun is at all times.

Having the ability to monitor the gun cycle enables the reactive rate of fire control scheme. When a user inputs a certain ROF and burst length for the next firing of the weapon, the control electronics take over. It disengages the sear 24, letting the weapon start to cycle and then reengages the sear 24 at the precise time required to realize the requested ROF or time in-between individual shots. Unlike contemporary, electrically initiated ROF controller triggers, the RWS 1 uses feedback from its sensors to tell the trigger exactly how long it should be pulled and not pulled. Because there are a plurality of proximity sensors running along the action of the gun, computations as to operating group velocity and position can be made near instantaneously. This data is fed back into the control electronics which implements the correct triggering sequences. This is true regardless of whether the gun starts to run slow, possibly because it is dirty, or speeds up, possibly because it is hot. Conventional systems simply use an average natural ROF to calculate how long the trigger pulses on and off; however, this scheme has no ability to react to individual differences in between shots that occur during firing.

The ability to adaptively vary parameters to keep ROF precise is advantageous for a number of reasons. Weapon systems have a natural frequency, which is determined by properties like the mass of the moving parts, cartridge impulse, mass of stationary parts, springs being compressed, dampers absorbing energy and many other variables. Accordingly, for each individual weapon, there is a "sweet spot" firing rate that takes advantage of harmonic motion and stabilizes the gun. It has been shown that different guns bounce and sway differently based on their rates of fire. This movement is the biggest contributor to dispersion or the spread out pattern that the rounds make at the target. For precision weapons, this spread must be kept to a minimum. It has also been shown that differences as little as one or two rounds per minute can dramatically alter the shot dispersion characteristics of a gun. The RWS 1 reactive ROF system allows this ultra-fine tuning to be done on the spot with ease, thereby enhancing its capabilities as a precision weapon. The reactive ROF system will also be helpful in quality control of mass produced ammunition and gun barrels. Ammunition and barrels must undergo dispersion testing to determine how much of the weapon's error budget is accounted for by those components. Having exact ROF reliability on a testing setup will eliminate intrusive variables that could scrap out otherwise fine products, producing savings.

Equally upsetting to precision fire is out-of-battery firing. This occurs when a shot is early or late in the normal back and forth recoil motion of the gun on the mount. For precision, the gun should only fire when it has settled or nearly settled into its steady-state position (or some other predefined location). Sensors for determining the location of the weapon with respect to the mount, as well as accelerometers for determining if/when a shot has fired are built into the RWS 1. This arrangement allows for the timing of shots, such that they occur only when the weapon is in an ideal position during the period of recoil. In addition to/alternatively, timing control can be used to reduce recoil forces transmitted to a UGV or whatever the RWS 1 is mounted to. If the timing were made such that firing only occurs while the weapon is still moving forward, all of that inertial momentum must be exhausted by the cartridge impulse (such as in advanced primer ignition systems)

In addition, the RWS 1 employs an ammunition handling system with a dual-feeder assembly. Advantageously, the dual-feeder assembly allows the RWS 1 to carry a large amount of ammunition while still maintaining a low profile. In one embodiment, for example, the ammunition handling system allows at least 800 rounds of ammunition. The ammunition is divided and placed on both sides of the weapon, rather than in a single large container above, below or behind. This arrangement is furthermore made possible by having both the live cartridges and the spent links/cases entering and leaving the feeder from the same side, unlike the traditional throughput of other belt-fed weapons which requires empty space (left-to-right, for example).

The selection of ammunition is enabled by a remotely actuated dual-feeder assembly which switches between a left belt of ammunition and a right, in real time, with no human intervention. This unique system not only cuts down the height of the RWS 1 but also enables a user to have two different types of ammunition to select from. For example, an RWS 1 may carry straight ball ammunition on one side and a more traditional mix of ball and tracer on the other side. The user may then selectively fire one or the other depending on whether according to the mission they can reveal the RWS 1 position with tracer rounds. Alternatively this could also allow a user to deploy traditional ammunition as well as ammunition which may have a more specific purpose or may be more costly, such as non-lethal ammunition or armor penetrators. In particular, the remote charging ability of the RWS 1 enables the use of low impulse non-lethal rounds. This arrangement also enables first round fire select. The transfer mechanism moves the entire selected belt, contained in one of two symmetrical, redundant feed units, into or out of the feed position. In this manner, a single round of the previously selected belt is not left in the feed path and the newly selected ammunition type can be immediately fired.

A concern with remotely operated weapons, whether they be on a manned vehicle or UGV, is whether an enemy can incapacitate the delivery platform and steal the weapon, thereby turning its lethality against its owner. This is a particular issue on systems which use legacy weapons, which keep human intended ergonomic features like a butt-stock and grip. The RWS 1 is designed to be of no use to an enemy if dismounted. The weapon is inoperable when removed from its cradle. This has been achieved in two ways, at a system engineering level and at a component level. The RWS 1 separates the firing components from the ammunition handling components. The weapon sits in an active cradle assembly 3 which provides a mounting point and recoil attenuation. Unlike contemporary passive mounts, the active cradle assembly 3 contains all of the belt and ammunition handling machinery. When the weapon is removed, it does not have the ability to cycle ammunition. To provide further security, the gun itself is rendered inoperable when removed from the active cradle assembly 3 by spring loaded posts which impede the operating group.

Figure 2:
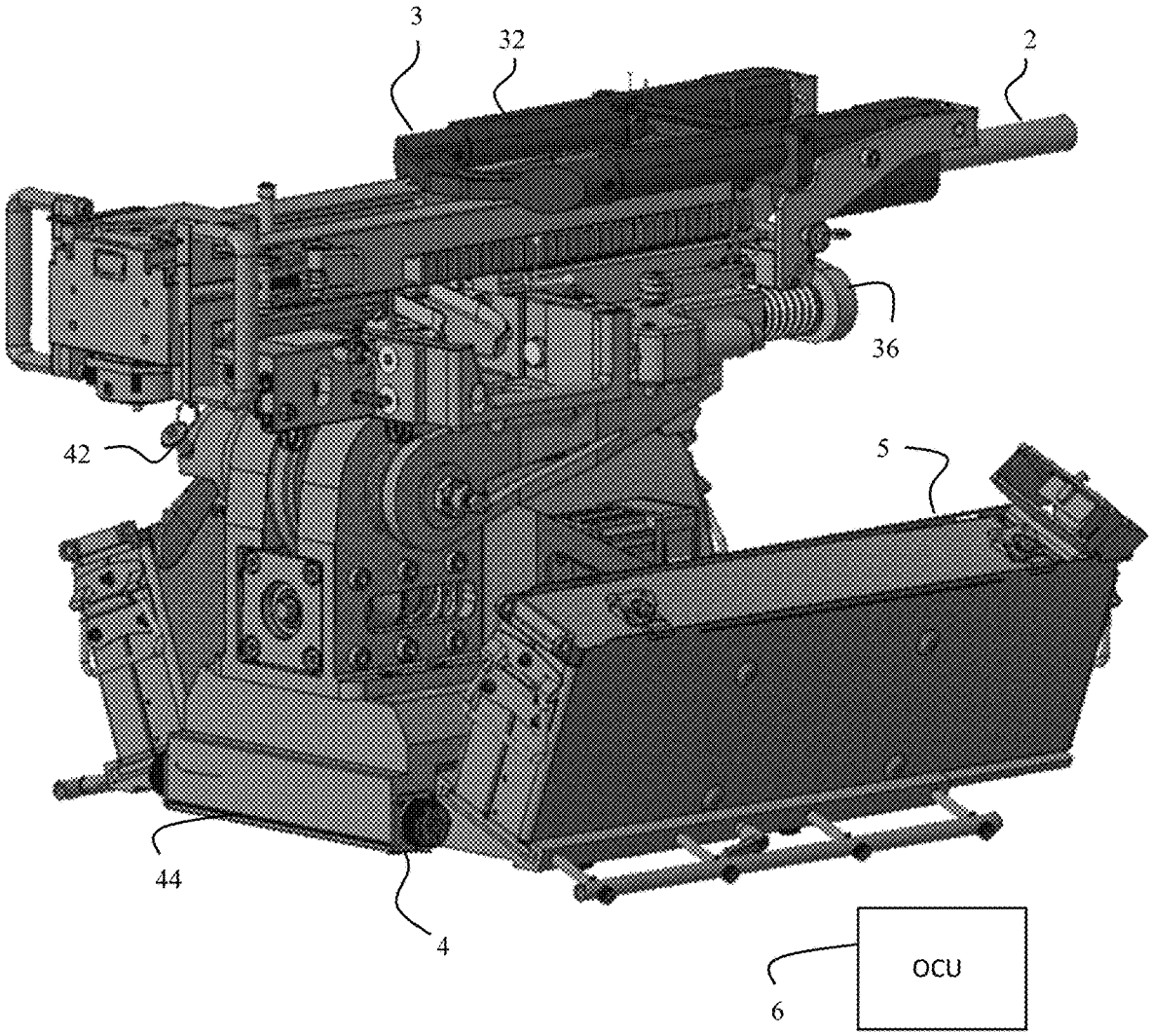
FIG. 2 is a back isometric view of a remote weapon station, according to an illustrative embodiment.

FIG. 1 is a front isometric view of a remote weapon station, according to an illustrative embodiment. FIG. 2 is a back isometric view of a remote weapon station, according to an illustrative embodiment. The RWS 1 is intended to be mounted on an unmanned ground vehicle (UGV) to provide small arms fire from the UGV. The RWS 1 comprises the weapon assembly 2, the remote charging assembly 32, the dual feeder assembly 34, the recoil mount 36, the elevation drive assembly 42, the azimuth drive assembly 44, and two high capacity ammunition magazines 5. The remote charging assembly 32, dual feeder assembly 34 and recoil mount 36 together form the active cradle assembly 3. The elevation drive assembly 42 and azimuth drive assembly 44 together form the multi-axis gimbal 4.

The weapon assembly 2 is a gas-powered, belt fed, rotating bolt lock, heavy barrel, 7.62×51 mm NATO design which operates similar to an M249 light machine gun (LMG) currently in use by the armed forces of the United States. However, the principles described above are not limited to this particular caliber or operating system. Those skilled in the art will appreciated that the RWS 1 may be adapted to fire other caliber ammunition.

The remote charging assembly 32 comprises electronic actuators which interface with the operating group 22 of the weapon system to charge the weapon and clear jams and obstructions.

The dual feeder assembly 34 feeds ammunition from one of the two high capacity ammunition cans to the weapon assembly 2. Both the live cartridges and the spent links/cases entering and leaving the feeder from the same side, unlike the traditional throughput of other belt-fed weapons (left-to-right, for example).

The recoil mount 36 serves as the platform on which the weapon assembly 2, dual feeder assembly 34 and remote charging assembly 32 is mounted. The recoil mount 36 comprises systems to mitigate recoil imparted by the weapon assembly 2 on the rest of the RWS 1. The recoil mount 36 is connected to and positioned by the multi-axis gimbal 4 to controllably direct fire.

The multi-axis gimbal 4 comprises an elevation drive assembly 42 and azimuth drive assembly 44 for directing the fire of the RWS 1. The elevation drive assembly 42 is connected to the recoil mount 36 and rotates the recoil mount 36 in relation to an axis to control the elevation of the weapon assembly 2. The elevation drive assembly 42 in turn is mounted on top the azimuth drive assembly 44 which rotates to control the azimuth of the entire system. The azimuth drive assembly 44 serves as the base of the RWS 1 and is configured to be mounted to a UGV. The elevation drive assembly 42 mounts on top of the azimuth drive assembly 44.

In addition, the RWS comprises control electronics for receiving user inputs, transmitting commands, receiving sensor inputs and running control software. The control electronics may be centralized or distributed throughout the RWS and in external components. In one embodiment, the control electronics further comprises a remote operator control unit (OCU) 6 which receives user inputs and interfaces with the various control electronics on the RWS. In embodiments described below, the OCU receives sensor inputs and makes determinations based on those sensors inputs. In alternative embodiments, this function may be performed by an on-board controller. For example, the user may use the OCU 6 to fire the RWS and input a desired rate of fire and burst length. The functionality of the RWS may be controlled entirely by user inputs to the OCU 6, other external inputs, such as other RWS, according to internal control functions of the control software or some combination of the above.

Figure 3:
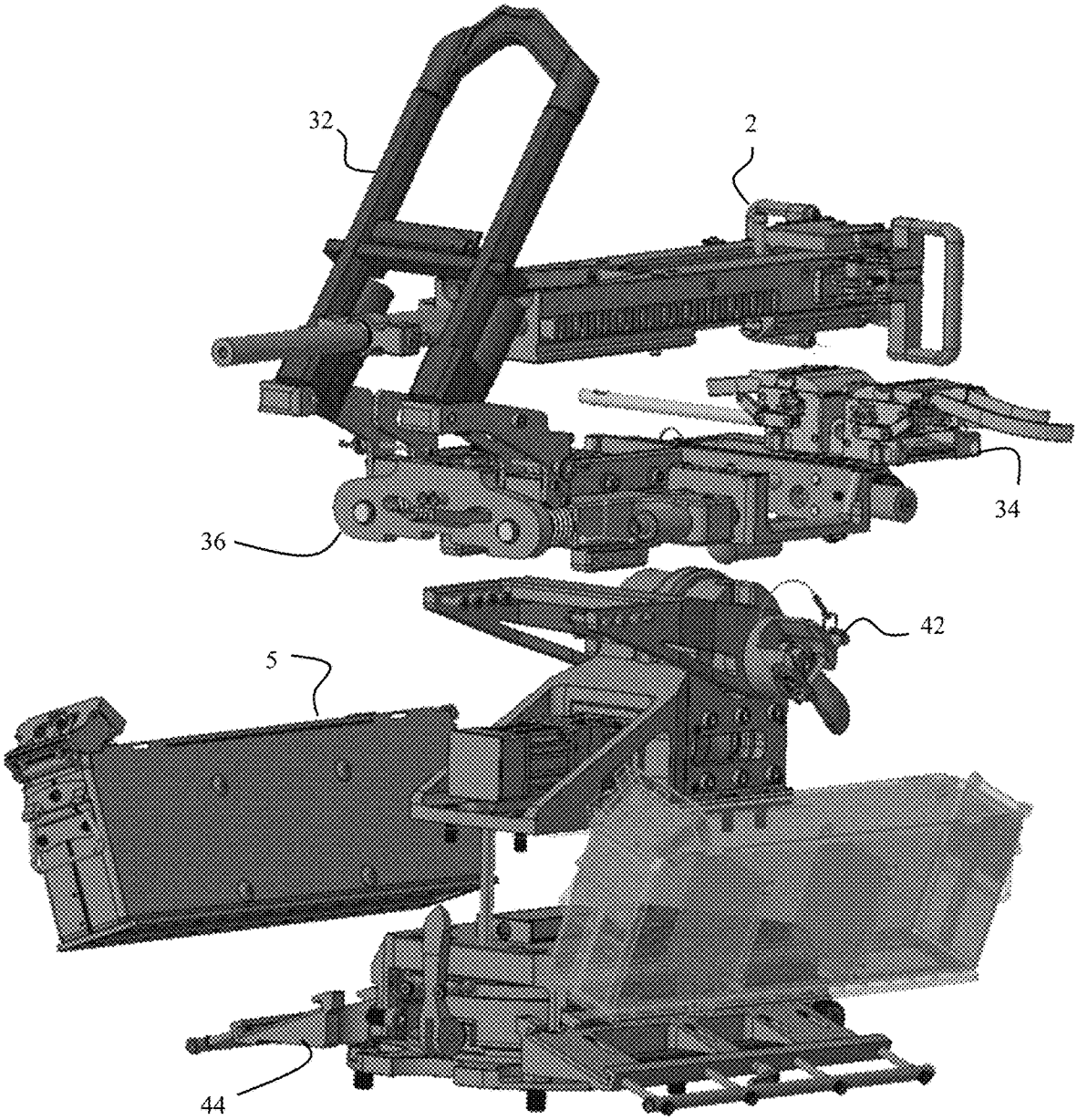
FIG. 3 is an exploded view of the remote weapon station, according to an illustrative embodiment.

FIG. 3 is an exploded view of the remote weapon station, according to an illustrative embodiment. The major subsystems of the RWS 1 are modular and attach and detach from each other via latches, quick-release pins, and other simple mechanical connections requiring no tooling. To assemble, first, the azimuth drive assembly 44 is placed on a corresponding platform, such as on the UGV, and bolted down. The elevation drive assembly 42 is located onto the azimuth drive assembly 44 and pinned in place. Cabling between the two snaps together when the elevation drive assembly 42 is pinned into place.

The active cradle assembly 3 is then assembled. The dual feeder assembly 34 is pinned onto the recoil mount 36. The remote charging assembly 32 is then pinned onto the recoil mount 36. The active cradle assembly 3 is connected to the multi-axis gimbal 4 by cross-pinning the recoil mount assembly 36 onto the elevation drive assembly 42 and plugging in cabling connecting the two.

The remote charging assembly 32 is lifted and the weapon assembly 2 is then placed into the recoil mount 36. The weapon assembly 2 is located onto the dual feeder assembly 34 and clamped in place. An ammo can is slid into each of the two holders on either side of the azimuth drive assembly 44 and restrained by thumb screws.

Figure 4:
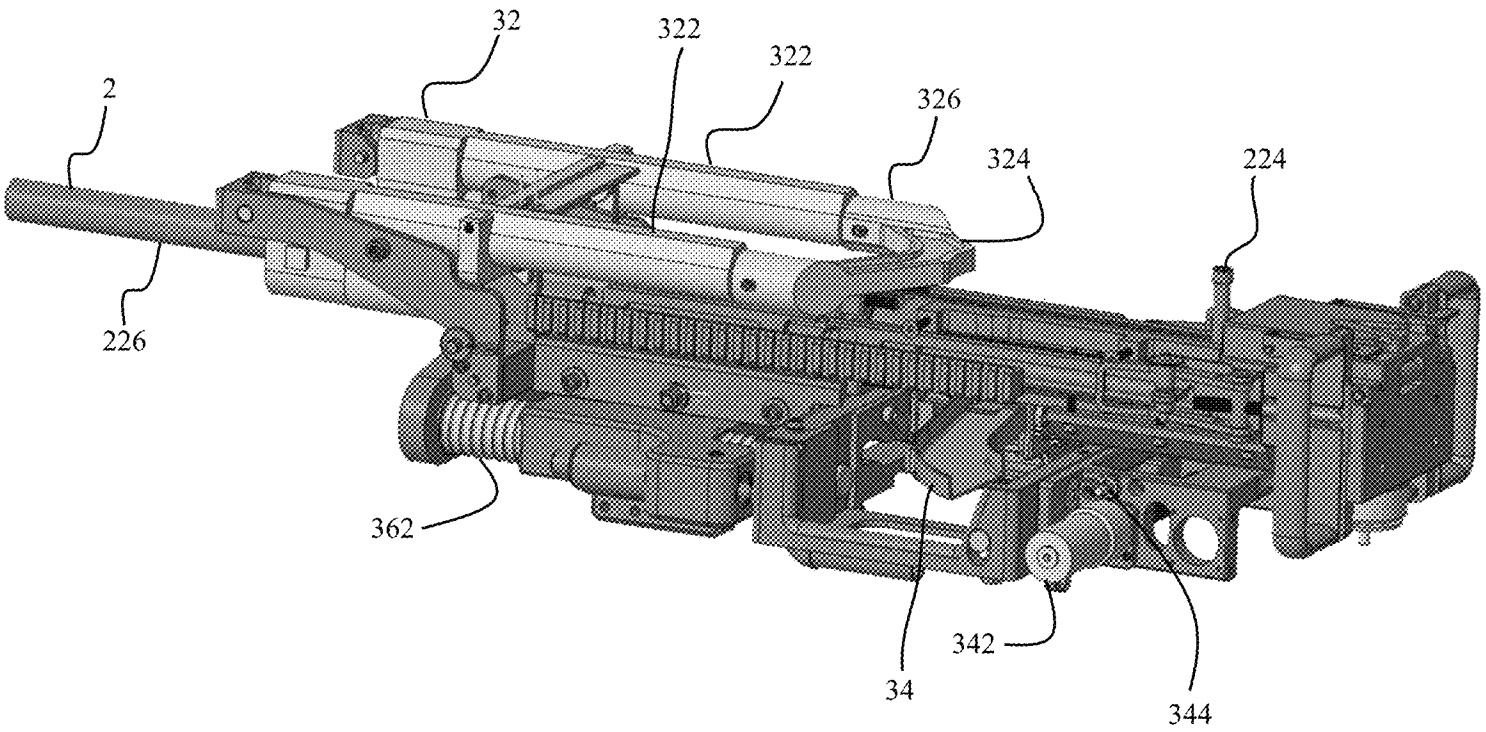
FIG. 4 is an isometric view of the weapon assembly and the active cradle assembly, according to an illustrative embodiment.
Figure 5:
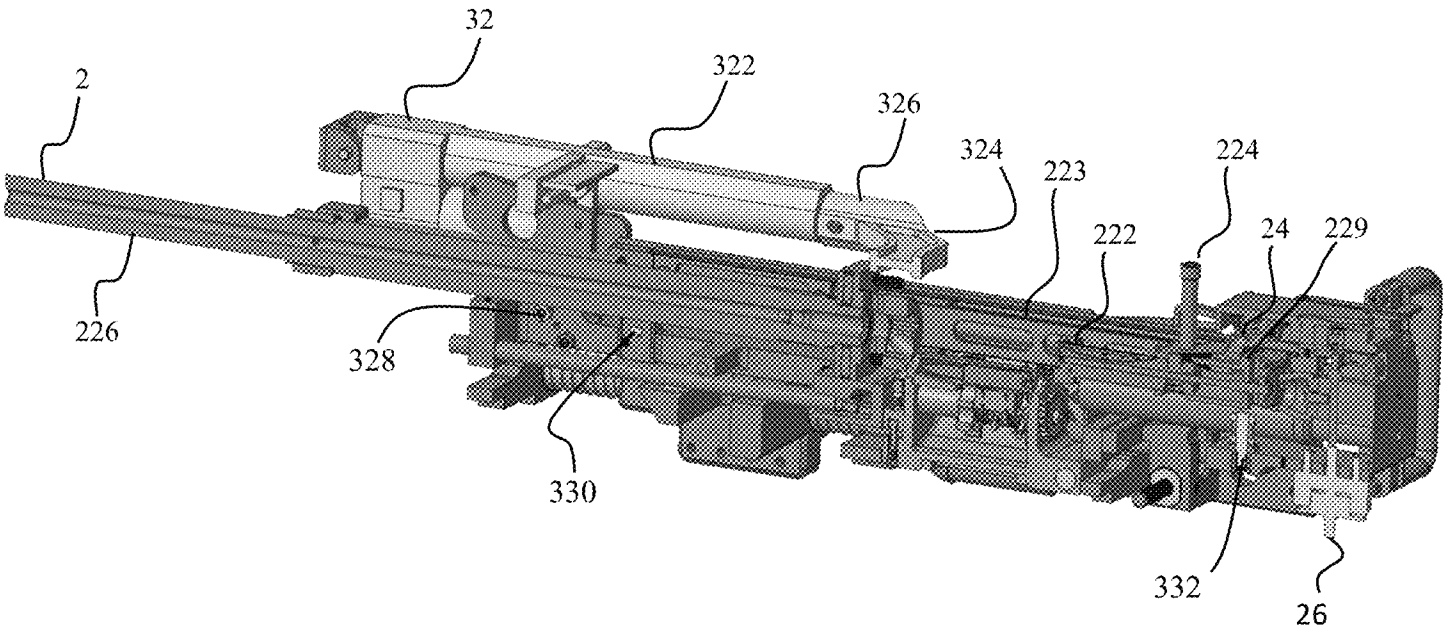
FIG. 5 is a cross-sectional view of the weapon assembly and the active cradle assembly, according to an illustrative embodiment.

FIG. 4 is an isometric view of the weapon assembly and the active cradle assembly, according to an illustrative embodiment. FIG. 5 is a cross-sectional view of the weapon assembly and the active cradle assembly, according to an illustrative embodiment.

Electro-mechanical components of the weapon assembly 2 and the active cradle assembly 3 enable the hybrid operating system wherein the weapon is gas powered but comprises electronic actuators to charge the weapon and clear jams and obstructions. The weapon assembly and active cradle enable precise control of the RWS 1 firing cadence for optimal terminal effects.

The remote charging assembly 32 is positioned above the weapon assembly 2. The remote charging assembly 32 further comprises linear charging actuators which enable the remote charging station to charge the operating group 22 rearward for initial operation and limited jam clearing. In one embodiment, the RWS 1 comprises a linear charging actuator 322 along a left side of the weapon assembly 2 and a linear charging actuator 322 along a right side of the weapon assembly 2. Each of the linear charging actuators 322 is axially aligned with the weapon assembly 2 such that the linear charging actuator 322 travels in a path parallel to the weapon barrel 226. The linear charging actuators 322 are oriented such that the piston 326 of each extends toward the rear, or breach, end of the weapon assembly 2. The two linear charging actuators 322 are connected at their pistons 326 by an interfacing member 324 which extends radially from each linear charging actuator 322. Extension of the linear charging actuators 322 causes a corresponding translation of the interfacing member 324 rearward in the axial direction of the weapon assembly 2. During this translation, the interfacing member 324 contacts the operating group charging handle 224 which protrudes in an upward direction from the weapon assembly 2 thereby charging the operating group 222 rearward.

The extended positions of the linear charging actuators 322 are controlled by a closed feedback loop such that the location of the linear charging actuators 322, as determined by the sensors described below, is checked at the operator control unit against what has been commanded. As will be described further below, additional jam clearing is also provided by the dual feeder assembly 34 which comprises a low power draw electric dual feeder actuator motor 342 enabling additional jam clearing resulting from feeding issues.

The weapon assembly 2 comprises an operating group 22. The operating group 22 further comprises a bolt 222, a bolt carrier 223, a sear surface 229 and an operating group charging handle 224. The operating group charging handle 224 extends upwards from the operating group 22 and provides an interfacing feature for the remote charging assembly 32 to charge the operating group 22 rearward. The sear surface 229 of the operating group 22 rides onto the sear 24 of the weapon assembly 2 to lock the operating group 22 in the rearward position. A firing solenoid 26 controls whether the operating group 22 is arrested or free.

The operating group 22 further comprises a bolt carrier 223 with an elongated U-shape. The elongated U-shape of the bolt carrier 223 helps actively impart air flow over the surface of the breech end portion of the barrel 226 during every cycle to help keep breech end operating temps lower, help with cook-off limit. When the bolt carrier 223 is in full counter-recoil position, the legs of that part extend well past the barrel extension and alongside the barrel 226 on each side.

Various sensors further enable operation of the RWS 1. A linear potentiometer 362 located at the forward end of the recoil mount assembly 36 reads the position of the recoiling weapon assembly 2 with respect to the stationary mount 36. Feeder proximity sensors 344 located at the aft end of the recoil mount assembly 36 sense whether the left or right hand feed unit is deployed. An accelerometer 328 located proximate the barrel 226 of the weapon assembly 2 provides information about when a shot has been fired by sensing the fired shot's impulse. A barrel temperature sensor 330 located at the forward end of the recoil mount assembly 36 reads barrel surface temperature. Bolt proximity sensors 332 located along the path of the operating group 22, at least at the forward and rear end of the path, indicate where the operating group 22 is with respect to the weapon.

To operate the weapon, the remote charging assembly 32 initially charges the weapon. According to control signals received from the operator control unit 6, the linear charging actuators 322 charge the weapon by translating the operating group 22 backward. While the operating group 22 is in its foremost position and no ammunition is in the barrel 226, the linear charging actuators 322 catch hold of the operating group charging handle 224. The operating group 22 is brought rearward against drive springs into a position such that the sear surface 229 rides onto the weapon assembly sear 24 thereby locking the operating group 22 to the rear.

The action of moving the operating group 22 backward loads a round 52 into the ready position to be stripped, fed and fired.

The linear charging actuators 322 are then retracted to a partially extended position approximately a quarter inch from fully retracted. This provides a physical safety feature for the RWS 1. If the operating group 22 were to somehow come off sear 24, such as if the sear 24 is broken, the operating group 22 would contact the partially extended linear charging actuators 322 thereby preventing a round 52 from firing.

Only upon a command to fire being given at the OCU 6 do the linear charging actuators 322 retract fully. When the fire command is given, the linear charging actuators 322 fully retract. The RWS 1 may release the sear 24 according to an external control signal received by the RWS 1 or according to an internal control function, such as target recognition software. For example, the operator control unit may receive a wireless signal from a soldier or another autonomous system, such as a leader in an autonomous swarm, to depress the trigger.

The operator control unit 6 then powers the firing solenoid 26 causing the solenoid 26 to release the sear 24 and allowing the operating group 22 to move forward under its drive springs and operate the weapon.

The operating group 22 moves forward under drive spring pressure and strips a round 52 presented from the dual feeder assembly 34. Locking is by conventional rotating bolt 222 and a fixed firing pin ignites the primer. The expanding gas from the propellant cycles the weapon thereafter with the operator control unit 6 controlling the rate of fire and burst length as will be described further below. Cartridge extraction and ejection is done in a manner typical of similar weapons except that the spent cartridge exits the same side as it is fed.

Upon the operator control unit 6 recognizing a jam condition, the linear charging actuator 322, in response to a control signal from the operator control unit 6, pulls back the operating group 22, thereby clearing the jam and resetting the weapon assembly 2 for continued operation. A jam is detected by the synergy of on-board sensors. For example, sensor data that the operating group 22 is not moving or that a shot has not been fired will indicate a jam condition.

The rate of fire and burst length of the RWS 1 are settable. For example, the OCU 6 may receive a user input comprising a desired ROF and a desired burst length for the next firing of the weapon. The solenoid 26 is then energized and deenergized in a controlled manner, such as through programming, to effectuate the desired ROF and burst length.

A plurality of bolt proximity sensors 332 are placed along the action of the gun, thereby allowing the operator control unit 6 to determine velocity and position of the operating group 22. Computations as to its velocity and position can be made near instantaneously. This data is fed back into the control electronics which implement the correct triggering sequences.

Figure 6:
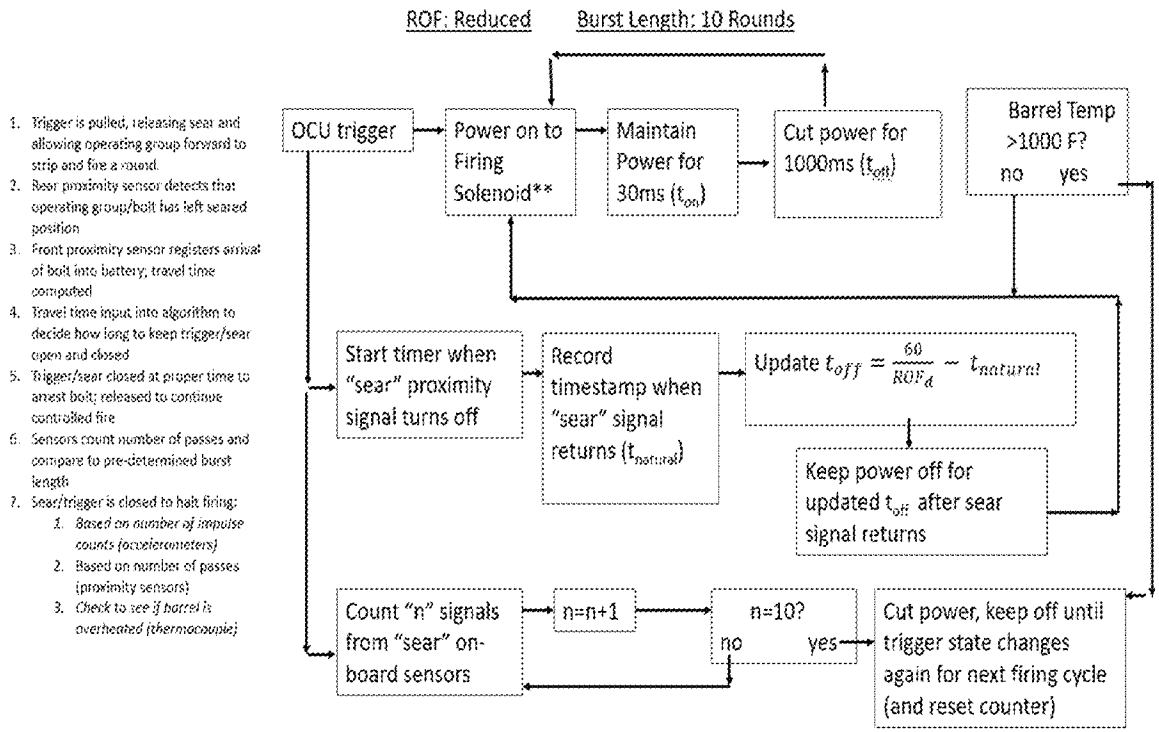
FIG. 6 is a flow diagram illustrating a method of enabling a variable reactive precision rate of fire control, according to one illustrative embodiment.

FIG. 6 is a flow diagram illustrating a method of enabling a variable reactive precision rate of fire control, according to one illustrative embodiment. In step 602, the operator control unit 6 pulls the trigger by providing power to the firing solenoid 26 (step 604), thereby releasing the sear 24 and allowing the operating group 22 forward to strip and fire a round 52.

In step 606, power to the solenoid 26 is maintained for a predetermined amount of time, ton. ton is based on the worst case time required for the solenoid 26 to move the sear 24 out of place, against its return spring.

In step 608, power to the solenoid 26 is cut for a predetermined amount of time, toff. toff is initially set to an amount determined by empirical measurements during setup. However, toff is dynamically updated after each round 52 is fired. After toff has elapsed, the solenoid 26 is re-energized for ton.

After step 602, simultaneous with the solenoid 26 being energized, at step 610 a rear proximity sensor 332 detects that the operating group 22 has left the seared position and a timer is started when the "sear" proximity signal 332 turns off.

In step 612, a front proximity sensor 332 registers the arrival of the operating group 22 into battery and the time is recorded as tnatural.

In step 614, toff is updated according to the following formula: toff=60/ROFd−tnatural. ROFd is the "desired," rate of fire selected by the user. toff is updated dynamically after each shot.

In step 616, power to the solenoid 26 is cut for the predetermined amount of time, toff.

In step 618, subsequent to step 602, a count, n, of each time the proximity sensors 332 sense the sear 24 is set to zero.

In step 620, n is increased by one when the rear proximity sensor 332 senses the return of the operating group 22.

In step 622, n is compared to the preset burst length to determine if the desired burst length has been met. In this example, the burst length has been set at ten.

If the burst length has not been met, the flow loop returns to step 620. If the burst length has been met, in step 624, power is cut to the solenoid 26. The solenoid 26 is deenergized until the trigger state changes for the next firing cycle. The flow loop then returns to step 618.

Simultaneously with the other steps described above, in step 626 a barrel temperature sensor 330 is monitoring the barrel temperature. If the barrel temperature exceeds a threshold temperature, in this example 1000 degrees Fahrenheit, then the flow loop proceeds to step 624 and power is cut to the solenoid 26.

Those skilled in the art will recognize that this is one method for enabling a reactive rate of fire. The functions of updating toff, determining if the burst length has been met and monitoring barrel temperature may be implemented by various methods of varying complexity.

While FIG. 6 shows a method for enabling a reactive rate of fire at a preset burst length, the operator control unit 6 can also control the timing of fire to correspond to a desired state of the weapon system. A linear potentiometer 362 between the recoiling weapon and the fixed mount provides positional information about the periodic motion between the two subsystems. In conjunction with an accelerometer 328 to sense when a round has been shot, firing can be made to occur only when the weapon is at a prescribed location within this period to enhance dispersion characteristics and/or reduce recoil.

Figure 7:
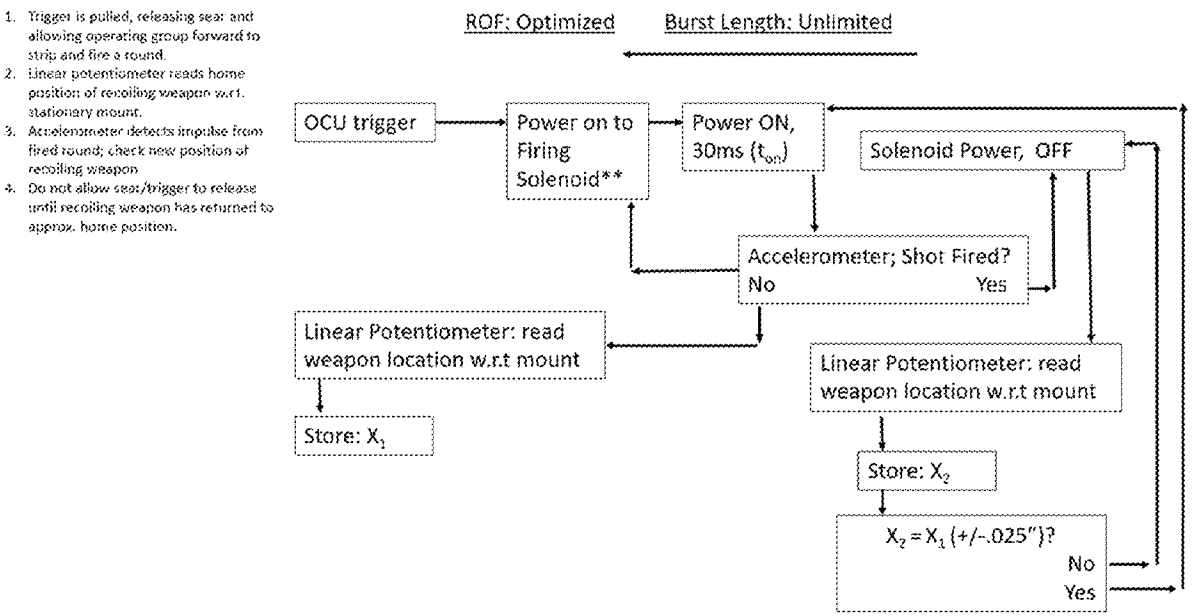
FIG. 7 is a flow diagram illustrating a method of enabling a reactive precision rate of fire control, according to one illustrative embodiment.

FIG. 7 is a flow diagram illustrating a method of enabling a reactive precision rate of fire control, according to one illustrative embodiment. In step 702, the operator control unit 6 pulls the trigger by providing power to the firing solenoid 26 (step 704), thereby releasing the sear 24 and allowing the operating group 22 to move forward to strip and fire a round 52.

In step 706, power to the solenoid 26 is maintained for a predetermined amount of time, ton. ton is based on the worst case time required for the solenoid 26 to move the sear 24 out of place, against its return spring.

In step 708, the accelerometer 328 detects whether or not a shot has been fired.

If a shot has not been fired, in step 710, the weapon location with respect to the recoil mount 36 is determined by the linear potentiometer 362. This location is stored as x1.

If a shot has been fired, in step 712, power to the solenoid 26 is cut off.

In step 714, the weapon location with the respect to the recoil mount 36 is determined by the linear potentiometer 362 and stored as x2.

In step 716, x2 is compared to x1 to determine if it is within a tolerance level. In this example, the tolerance level is set as 0.025 inches.

If x2 is within the tolerance level of x1, it is determined that the weapon assembly 2 is back in battery and step 706 is repeated with power being delivered to the solenoid 26 for a predetermined amount of time.

If x2 is not within the tolerance level of x1, it is determined that the weapon assembly 2 is not back in battery and step 712 is repeated.

Those skilled in the art will recognize that this is one method for enabling a reactive rate of fire which optimizes accuracy by ensuring that the weapon assembly 2 is in battery prior to firing. The functions of updating toff, determining if the burst length has been met and monitoring barrel temperature may be implemented by various methods of varying complexity.

The general approach described above may be tailored to focus on a different metric or benefit. For example, the RWS 1 may be controlled to fire when the weapon is at a predetermined position out of battery which provides better recoil mitigation by cancelling some of the impulse. In this example, x1 may be set at some position which provides optimal recoil cancellation and the system may not fire until it is determined that the weapon system is within some tolerance of this position.

Figure 8:
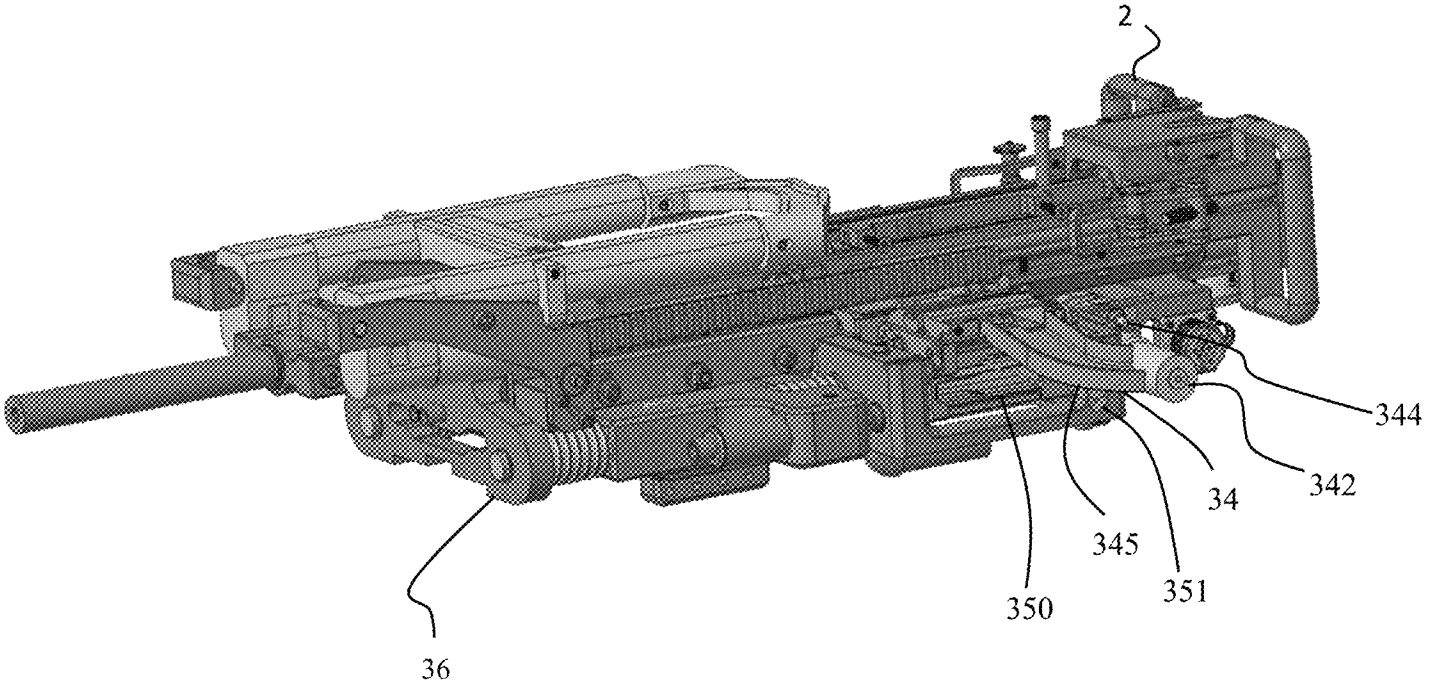
FIG. 8 is an isometric view of the weapon assembly and active cradle assembly showing the dual feeder assembly with a right hand feeder engaged, according to an illustrative embodiment.
Figure 9:
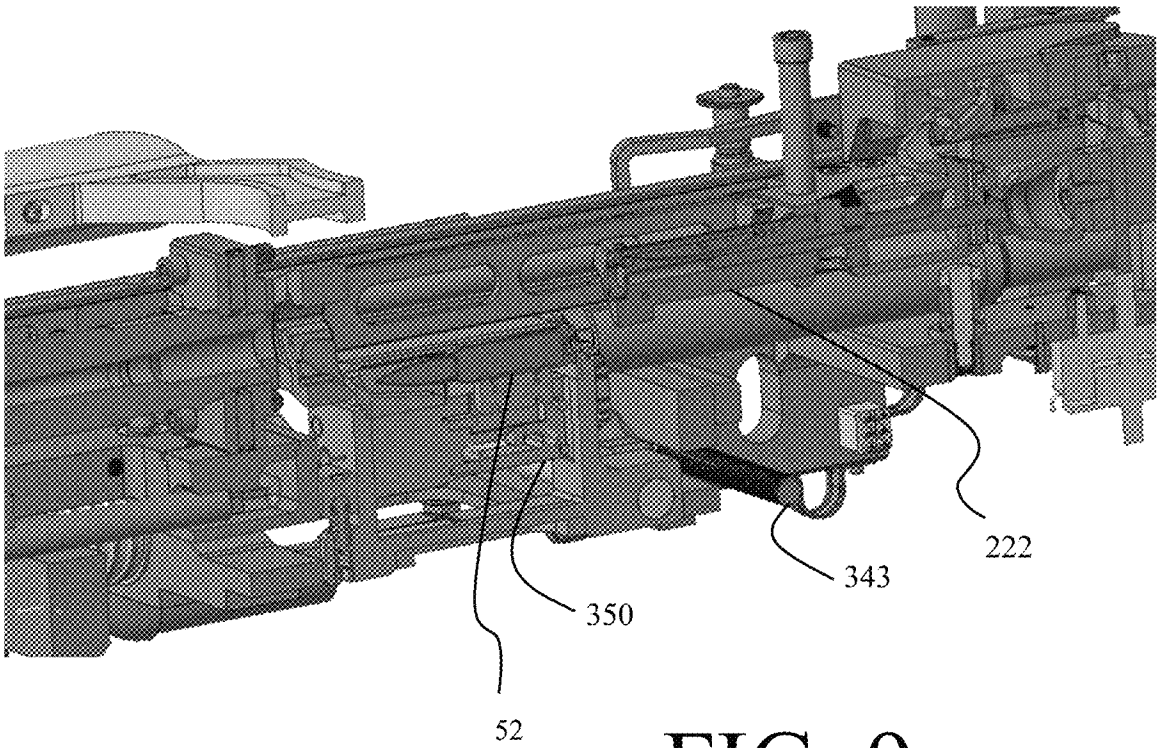
FIG. 9 is a cross-sectional view of the weapon assembly and active cradle assembly showing the dual feeder assembly with a right hand feeder engaged, according to an illustrative embodiment.
Figure 10:
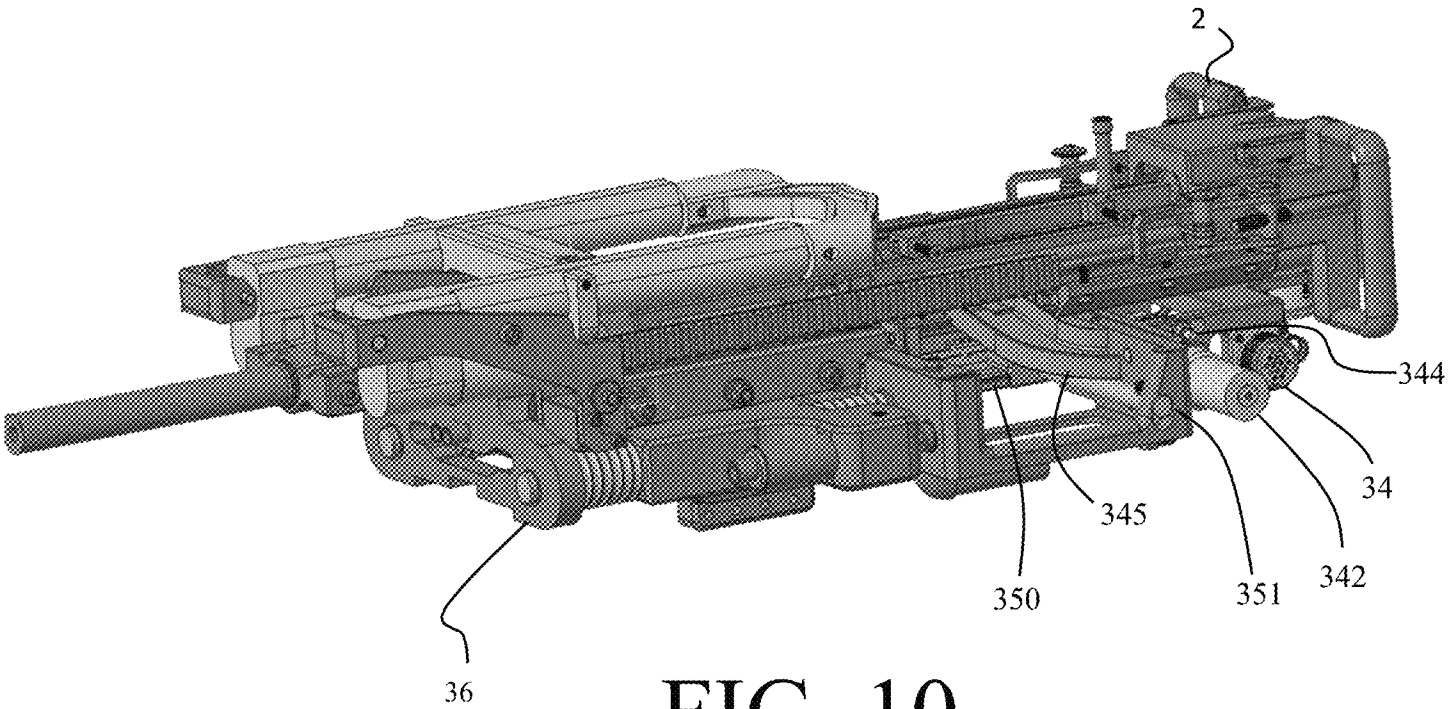
FIG. 10 is a cross sectional back plan view of the dual assembly feeder illustrating the throughput of ammunition in the assembly, according to an illustrative embodiment.

FIG. 8 is an isometric view of the weapon assembly and active cradle assembly showing the dual feeder assembly 34 with a right hand feeder engaged, according to an illustrative embodiment. FIG. 9 is a cross-sectional view of the weapon assembly and active cradle assembly showing the dual feeder assembly 34 with a right hand feeder engaged, according to an illustrative embodiment. FIG. 10 is an isometric view of the weapon assembly and active cradle assembly showing the dual feeder assembly 34 with a left hand feeder engaged, according to an illustrative embodiment.

Ammunition is fed into the weapon assembly 2 from the dual ammunition handling system located in the active cradle assembly 3. As described above, the ammunition handling system receives ammunition from a right-side ammunition can 5 and a left-side ammunition can 5. Depending on which side is active, the dual feeder assembly 34 presents a round 52 to the operating group 22 to strip, feed, fire and eject.

Figure 11:
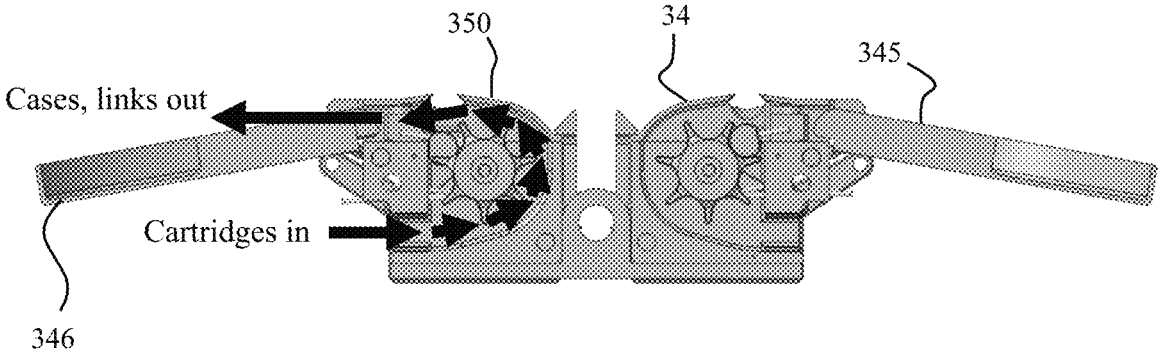
FIG. 11 is an isometric view of the weapon assembly and active cradle assembly showing the dual feeder assembly with a left hand feeder engaged, according to an illustrative embodiment.
Figure 12:
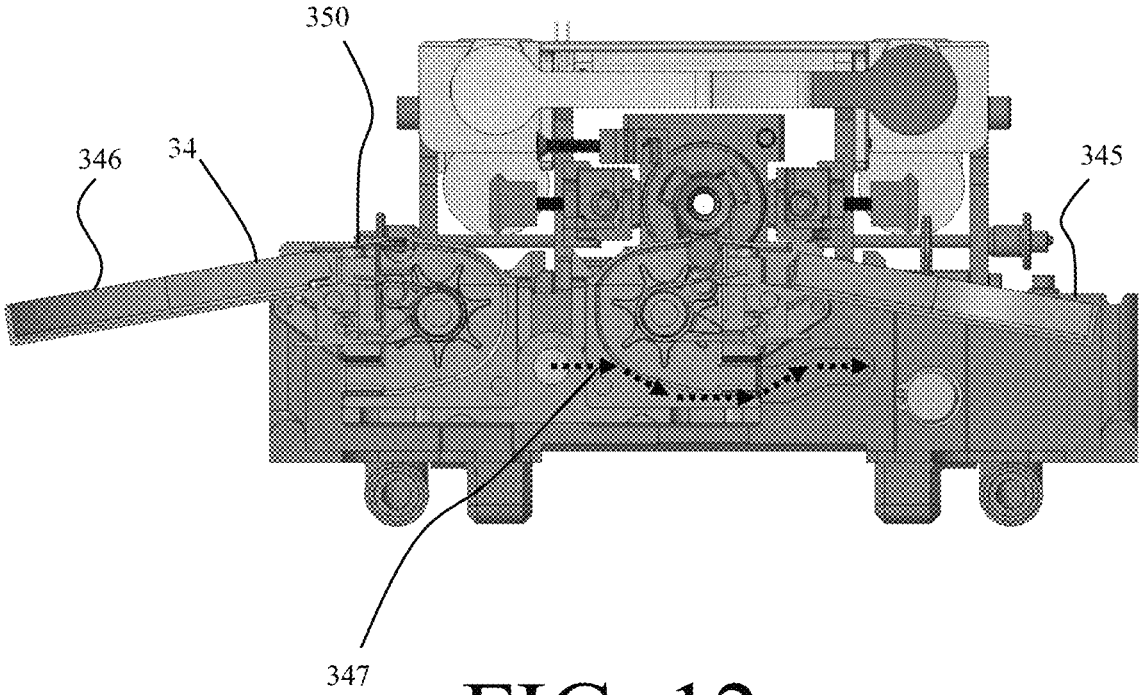
FIG. 12 is a cross sectional back plan view of the dual feeder assembly illustrating the path of the dual feeder assembly moving from a right hand to a left hand feeder, according to an illustrative embodiment.
Figure 13:
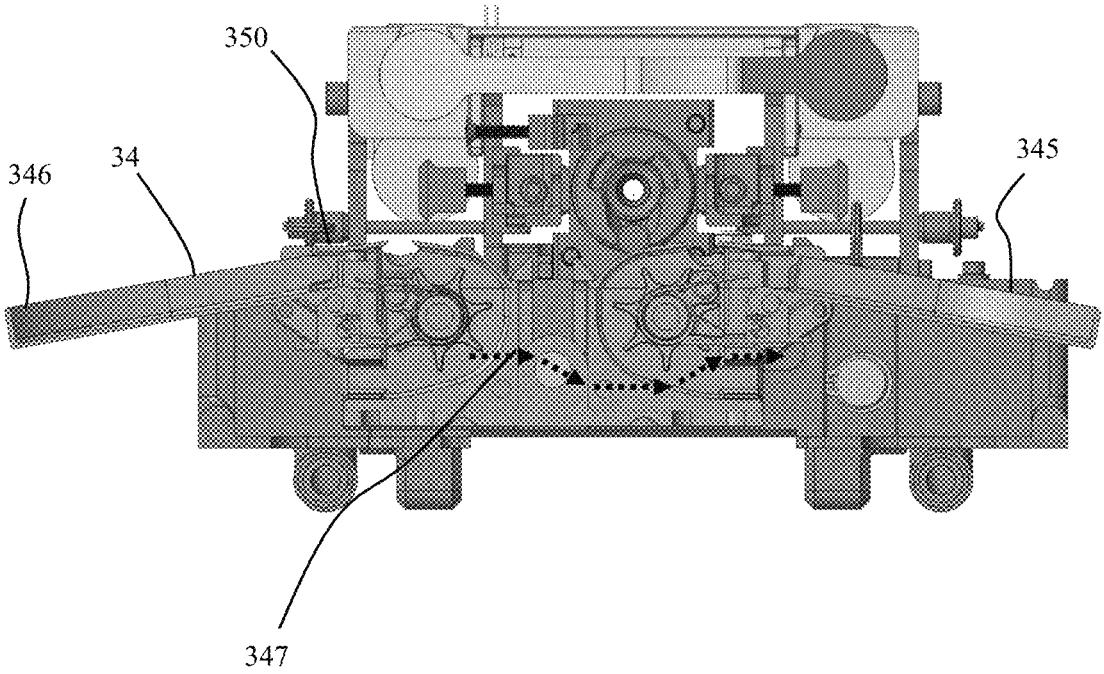
FIG. 13 is a cross sectional back plan view of the dual feeder assembly illustrating the path of the dual feeder assembly moving from a right hand to a left hand feeder, according to an illustrative embodiment.
Figure 14:
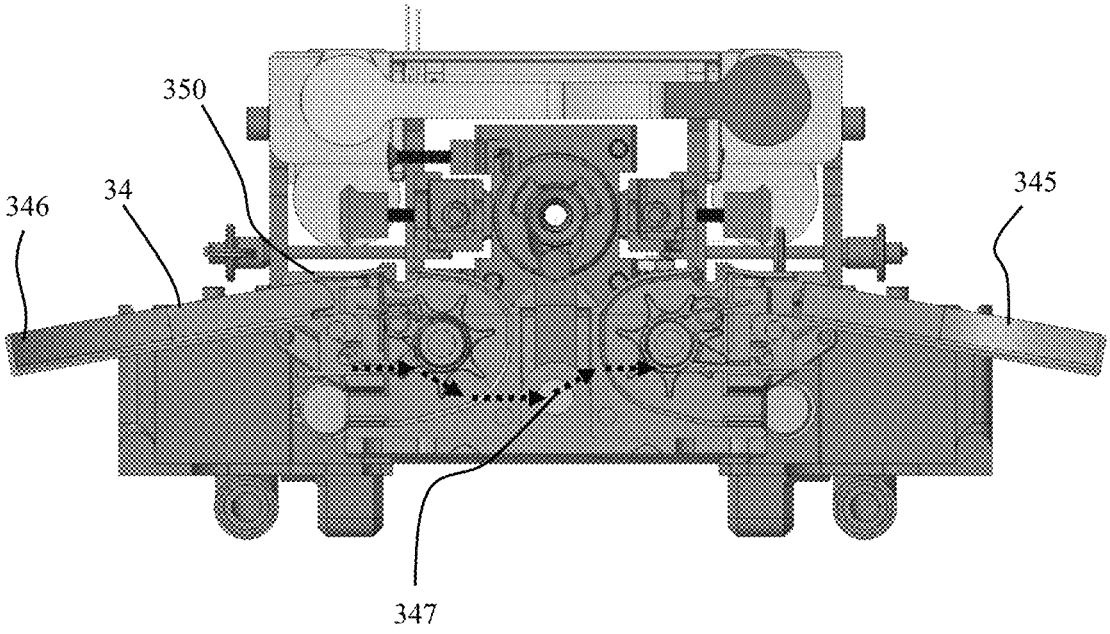
FIG. 14 is a cross sectional back plan view of the dual feeder assembly illustrating the path of the dual feeder assembly moving from a right hand to a left hand feeder, according to an illustrative embodiment.
Figure 15:
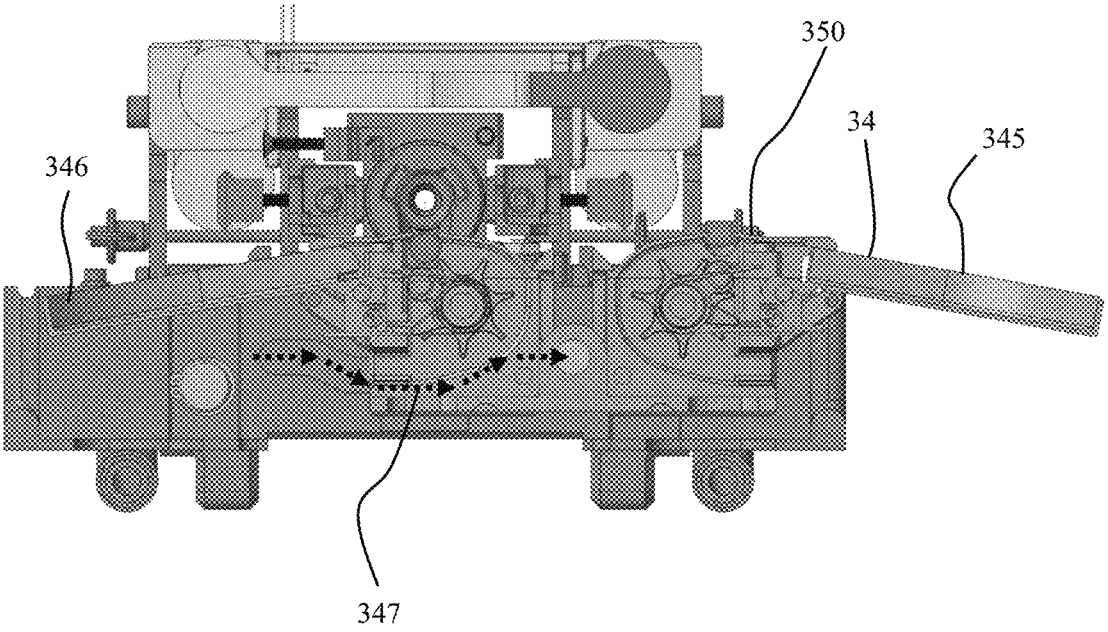
FIG. 15 is a cross sectional back plan view of the dual feeder assembly illustrating the path of the dual feeder assembly moving from a right hand to a left hand feeder, according to an illustrative embodiment.
Figure 16:
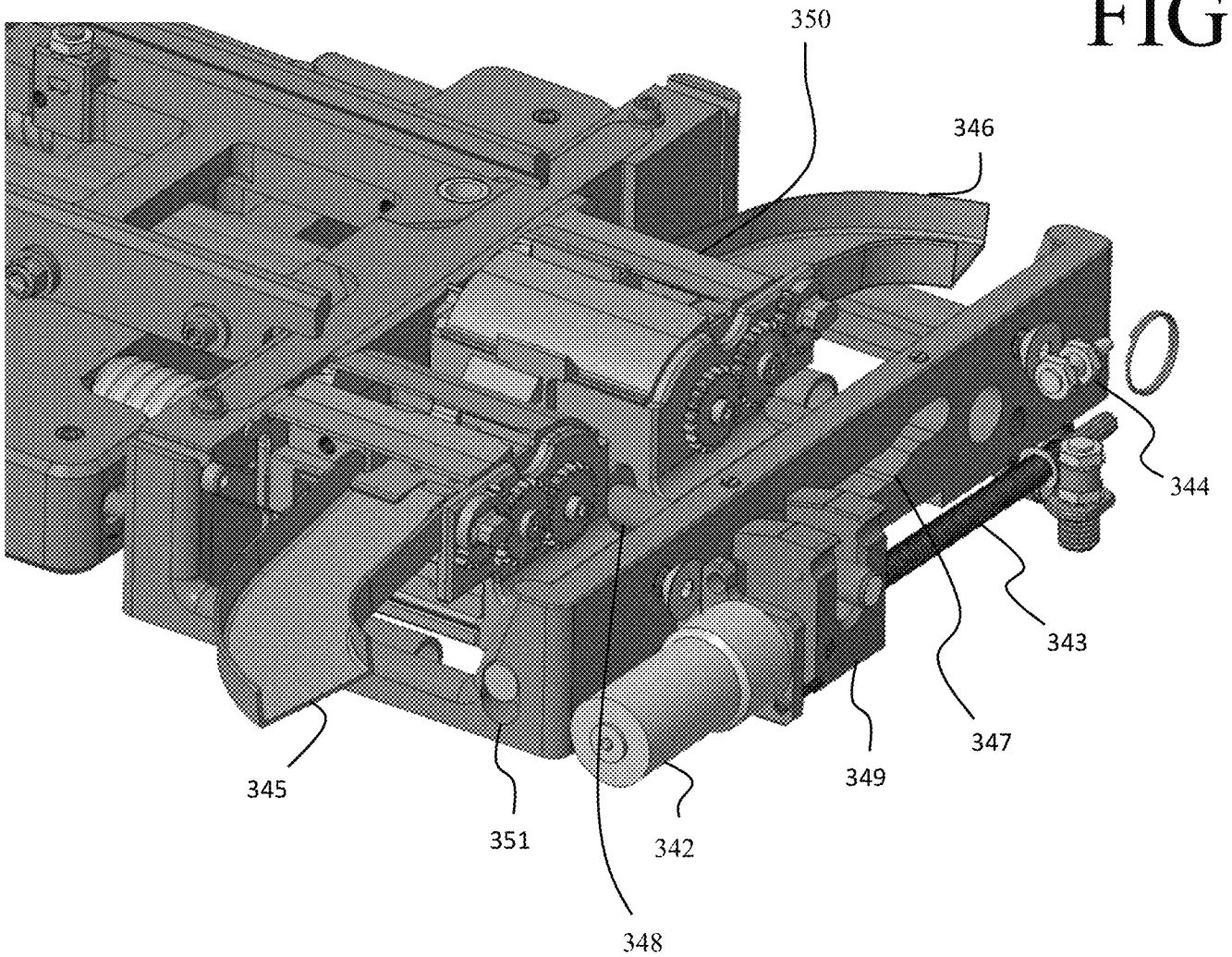
FIG. 16 is an isometric view of the dual feeder assembly illustrating the path of the dual feeder assembly moving from a right hand to a left hand feeder, according to an illustrative embodiment.
Figure 17:
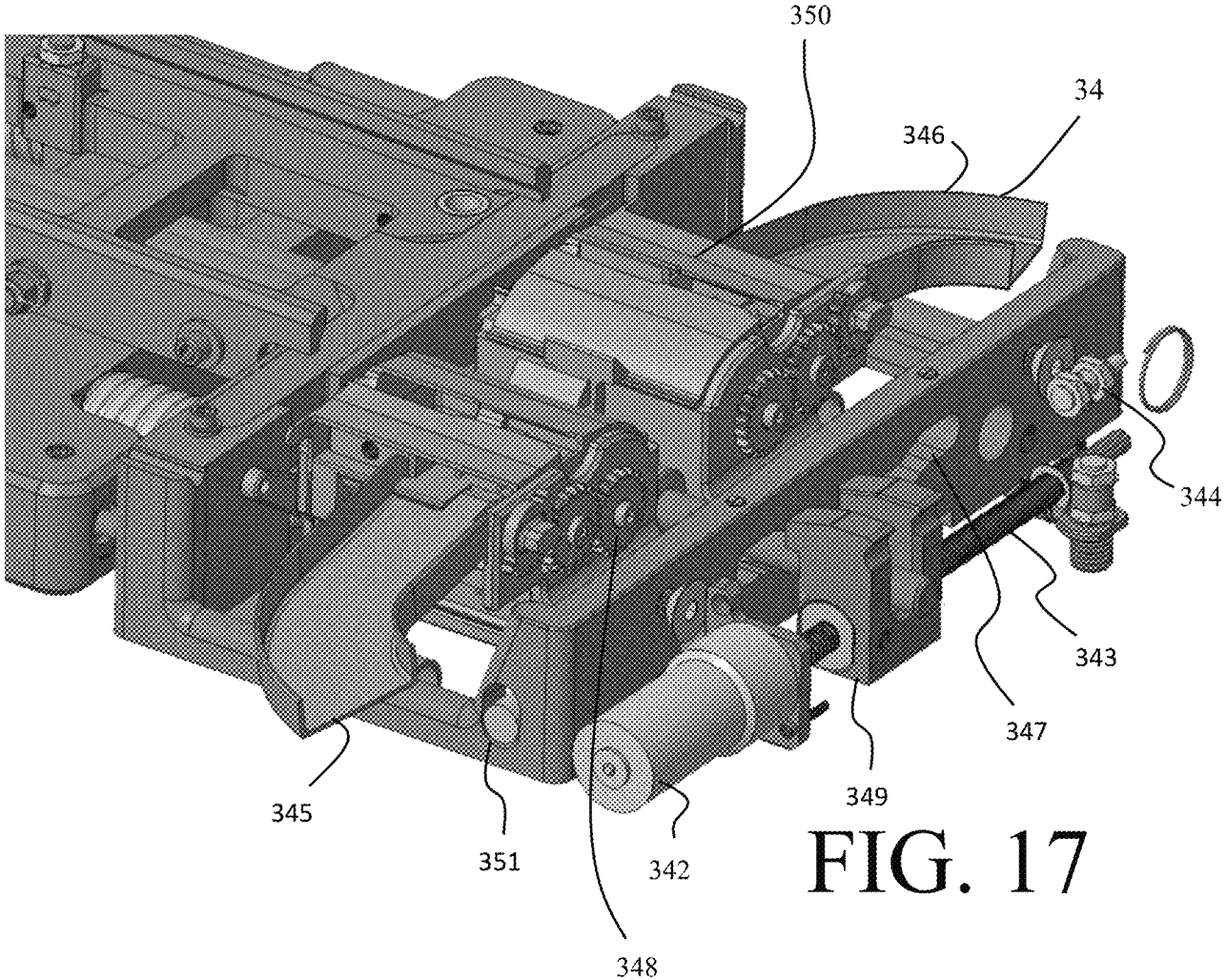
FIG. 17 is an isometric view of the dual feeder assembly illustrating the path of the dual feeder assembly moving from a right hand to a left hand feeder, according to an illustrative embodiment.
Figure 18:
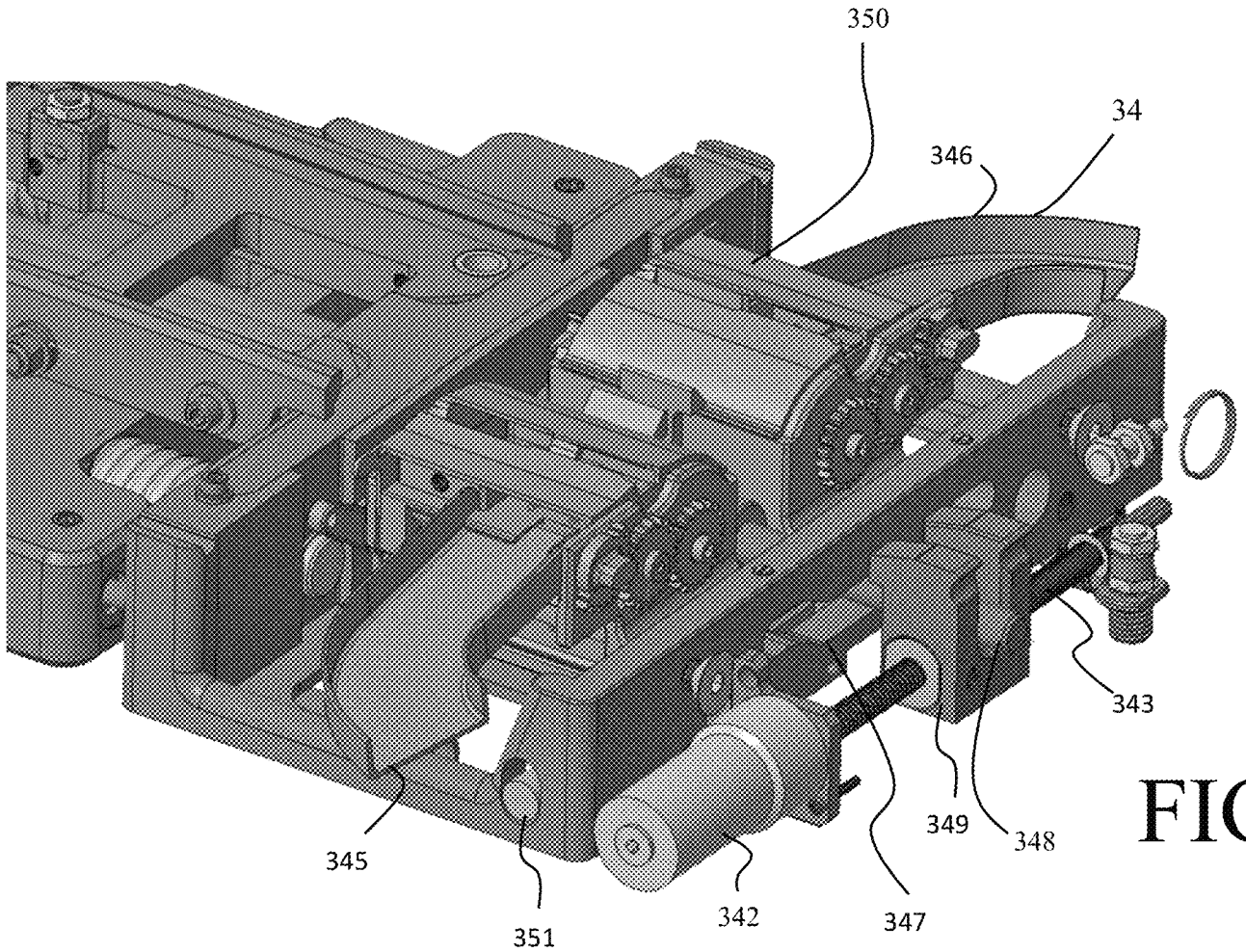
FIG. 18 is an isometric view of the dual feeder assembly illustrating the path of the dual feeder assembly moving from a right hand to a left hand feeder, according to an illustrative embodiment.
Figure 19:
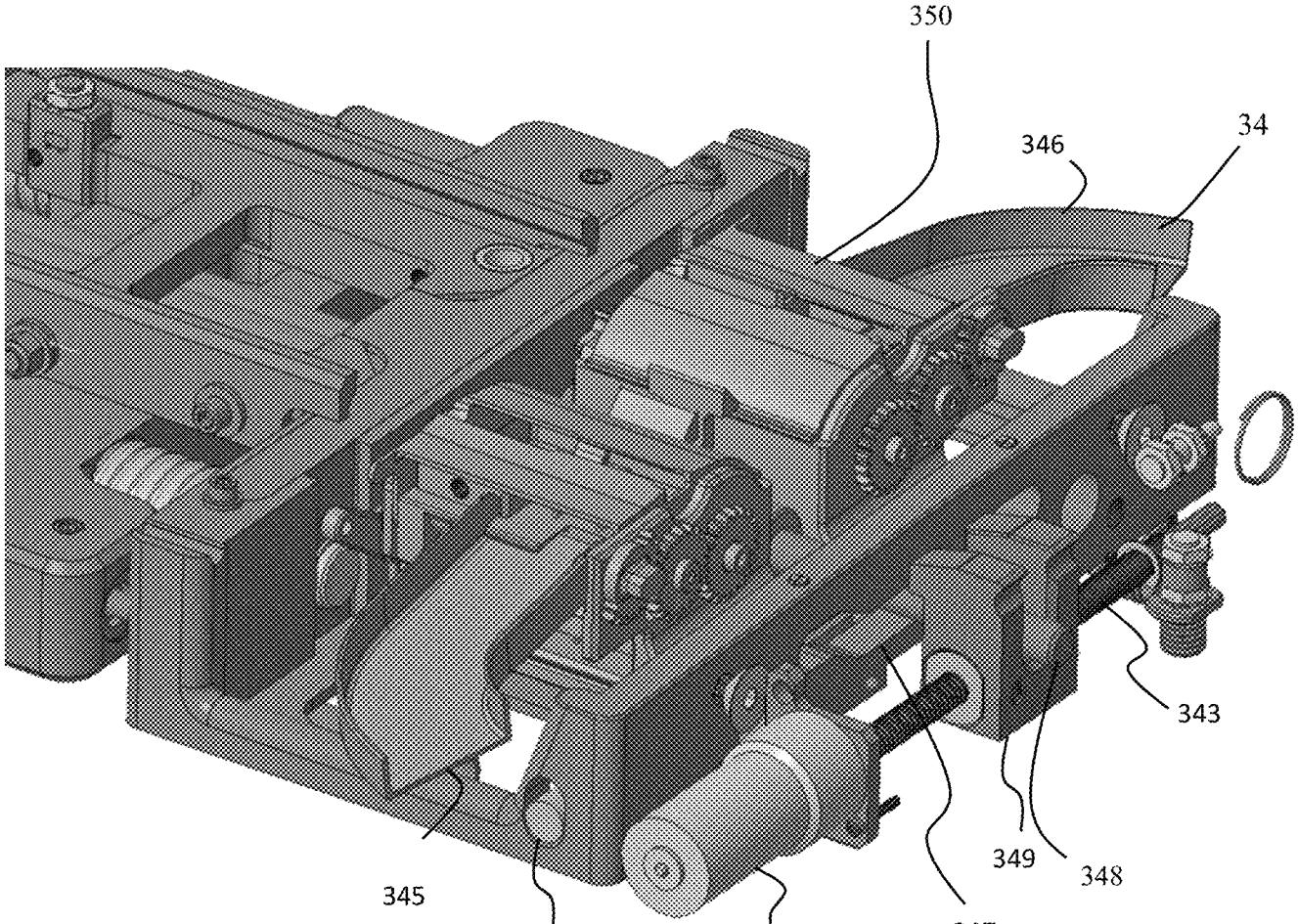
FIG. 19 is an isometric view of the dual feeder assembly illustrating the path of the dual feeder assembly moving from a right hand to a left hand feeder, according to an illustrative embodiment.
Figure 20:
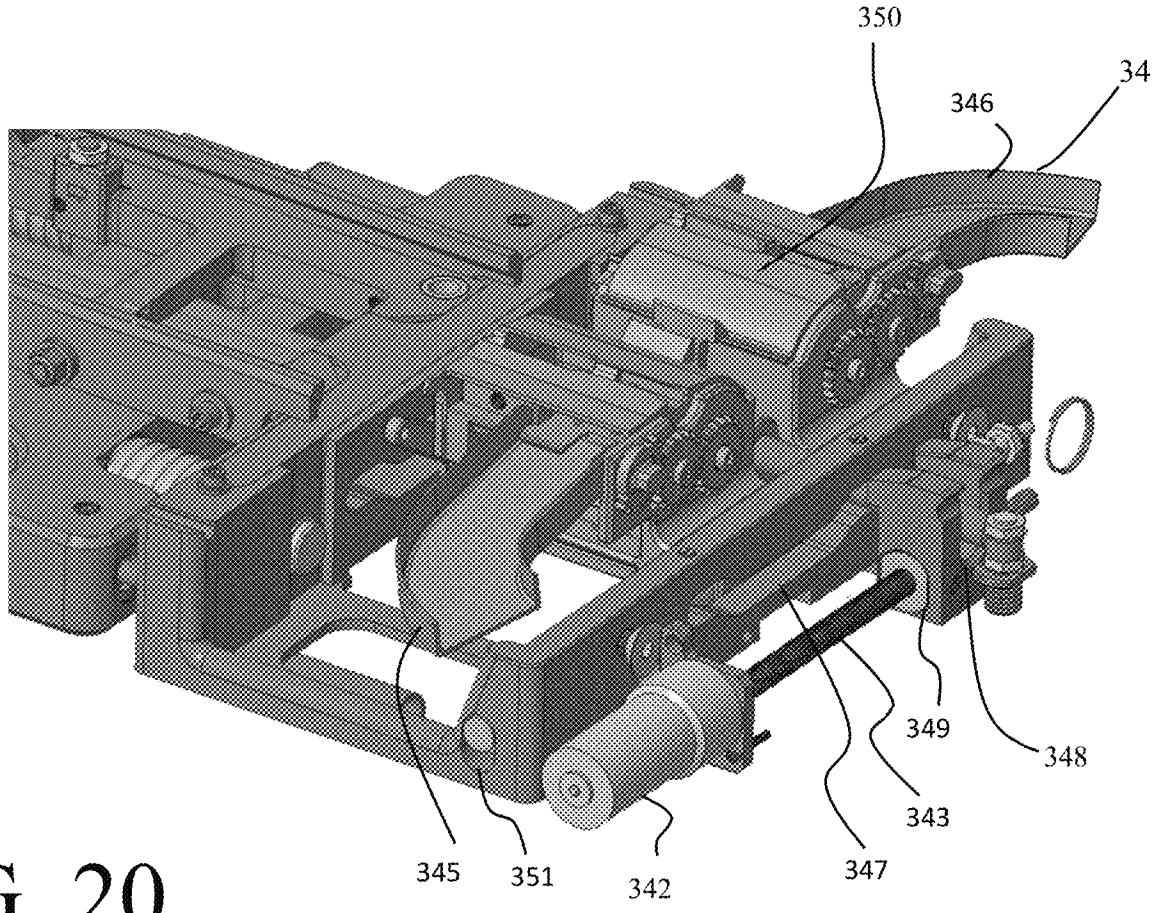
FIG. 20 is an isometric view of the dual feeder assembly illustrating the path of the dual feeder assembly moving from a right hand to a left hand feeder, according to an illustrative embodiment.

FIG. 11 is a cross sectional back plan view of the dual assembly feeder illustrating the throughput of ammunition in the assembly, according to an illustrative embodiment. To minimize RWS height, spent cases and links are ejected outward from feed-side rather than opposite-side and downward as is traditionally done. The traditional method of ejecting cases from the opposite side requires empty space.

The round 52 enters the dual feeder assembly 34 from an opening in the side of the dual feeder assembly 34. The spent cases and links are then ejected through an opening above the entrance opening.

FIGS. 12-15 are cross sectional back plan views of the dual feeder assembly 34 illustrating the path of the dual feeder assembly 34 moving from a right hand feeder to a left hand feeder, according to an illustrative embodiment. FIGS. 16-20 are isometric views of the dual feeder assembly 34 illustrating the path of the dual feeder assembly 34 moving from a right hand feeder to a left hand feeder, according to an illustrative embodiment.

To switch the active side of the dual feeder assembly 34, the dual feeder assembly 34 undergoes a remote actuation, two-dimensional translation, up and down and left and right. An electric dual feeder actuator motor 342 drives a lead screw 343 which in turn pushes or pulls the feeder carriage 350 along a main two dimensional cam path 347 and a vertical cam path 351 planned out so as not to hit any hardware in the way. A transverse cam shaft 348 partially positioned within a yolk 349 travels within the main cam path 347.

A latching system catches either the left or right side and holds it rigidly in place. The operating group 22 may then presented with a round 52 from that side ammunition can to strip, feed, fire and eject.

Figure 21:
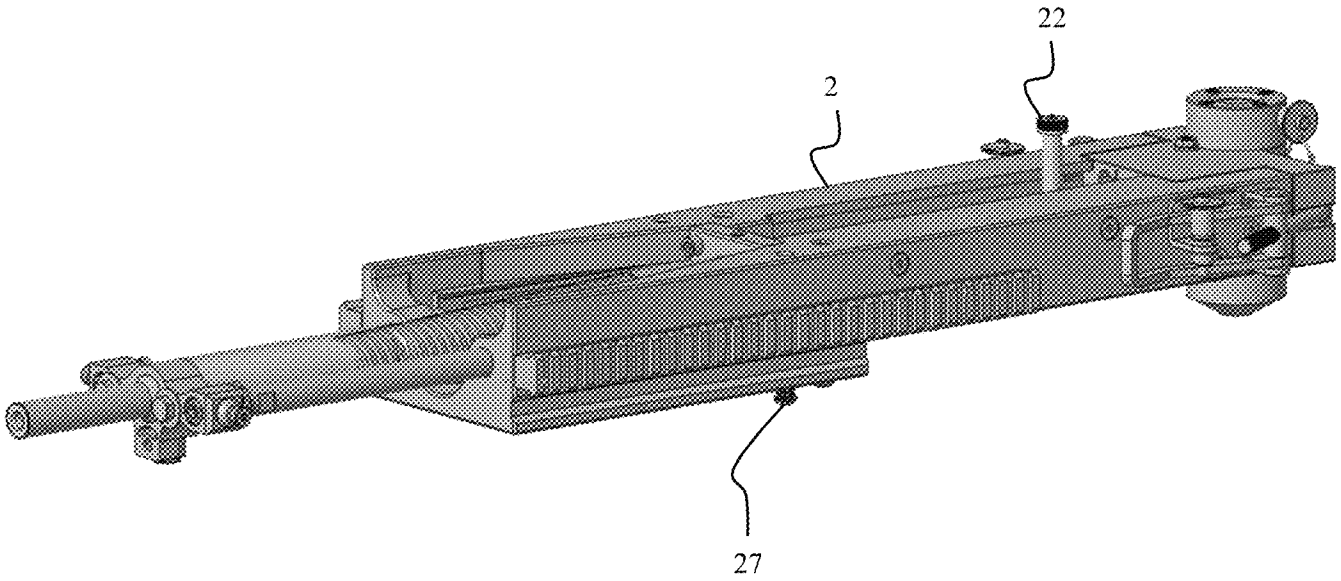
FIG. 21 is an isometric view of the weapon assembly illustrating a spring-loaded post safety feature, according to an illustrative embodiment.
Figure 22:
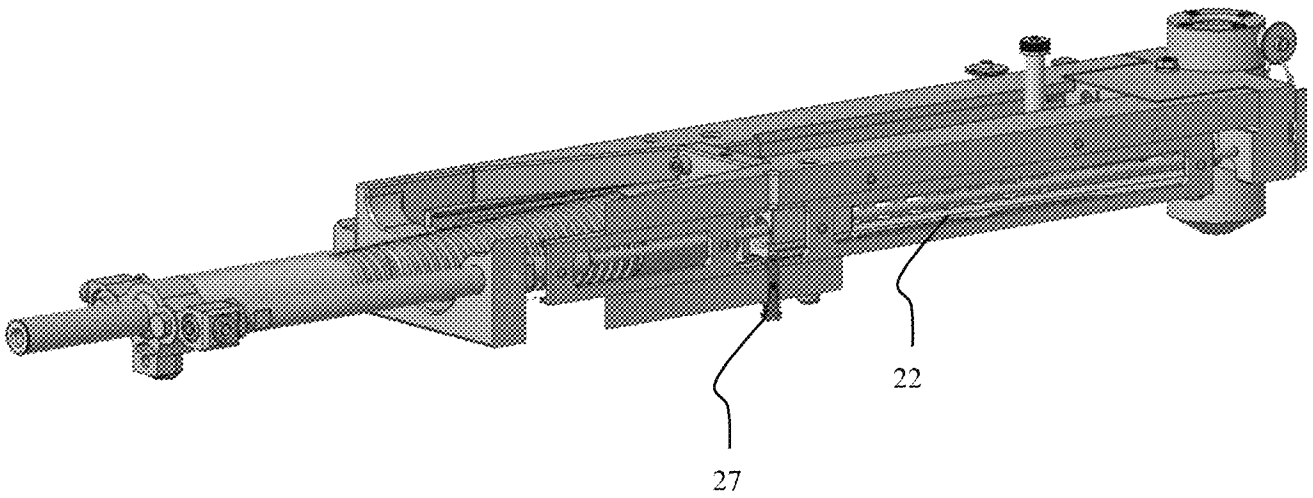
FIG. 22 is a sectional view of the weapon assembly illustrating a spring-loaded post safety feature, according to an illustrative embodiment.
Figure 23:
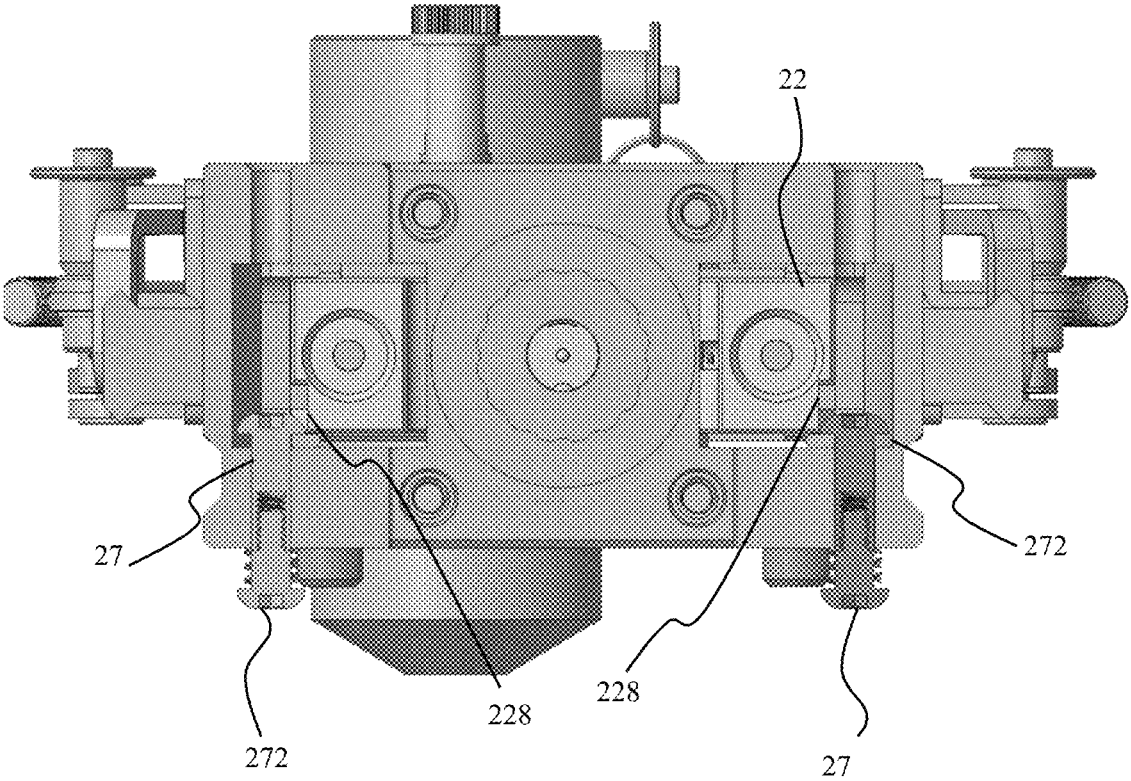
FIGS. 23 and 24 are cross sectional back plan views of the weapon assembly illustrating a spring-loaded post safety feature, according to an illustrative embodiment.
Figure 24:
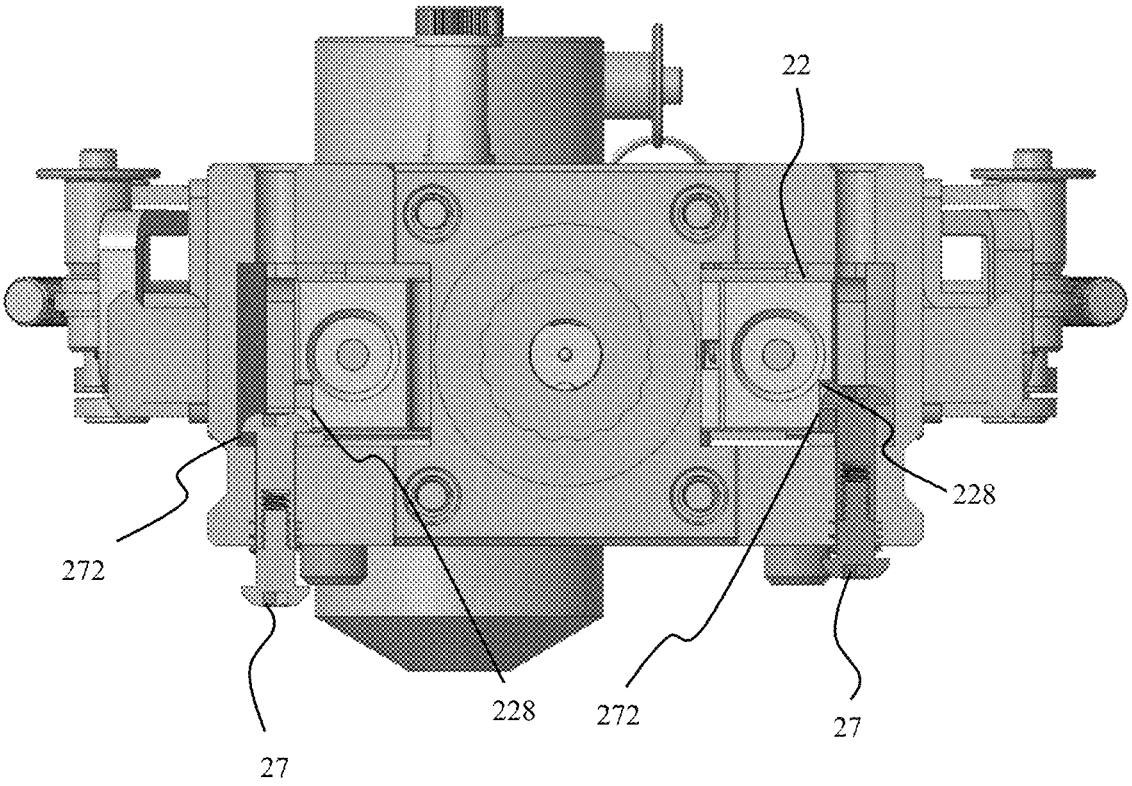

FIG. 21 is an isometric view of the weapon assembly illustrating a spring-loaded post safety feature, according to an illustrative embodiment. FIG. 22 is a sectional view of the weapon assembly illustrating a spring-loaded post safety feature, according to an illustrative embodiment. FIG. 23 is a cross sectional back plan view of the weapon assembly illustrating a spring-loaded post safety feature in a safe position, according to an illustrative embodiment. FIG. 24 is a cross sectional back plan view of the weapon assembly illustrating a spring-loaded post safety feature in an active position, according to an illustrative embodiment.

On either side of the weapon, spring loaded posts mate with corresponding cavities on the active cradle 3. When the weapon is removed from the cradle, the spring loaded posts 27 intrude into the path of the operating group 22, bringing it to an immediate halt. The posts 27 do not allow even a single, hand chambered round 52 to fire. The posts 27 are only removed when reintroduced into the cradle 3.

In the safe position (i.e. when the weapon assembly 2 is not in the active cradle assembly 3), the post 27 intrudes into the path of the bolt 222. When the weapon assembly 2 is inserted into the active cradle assembly 3, the force is sufficient to overcome the spring force and the post 27 is inserted further into the weapon assembly 2. The head 272 of the post clears a cut-out 228 in the operating group 22 thereby allowing translation when the spring is moved out of the way on the cradle 3.

Figure 25:
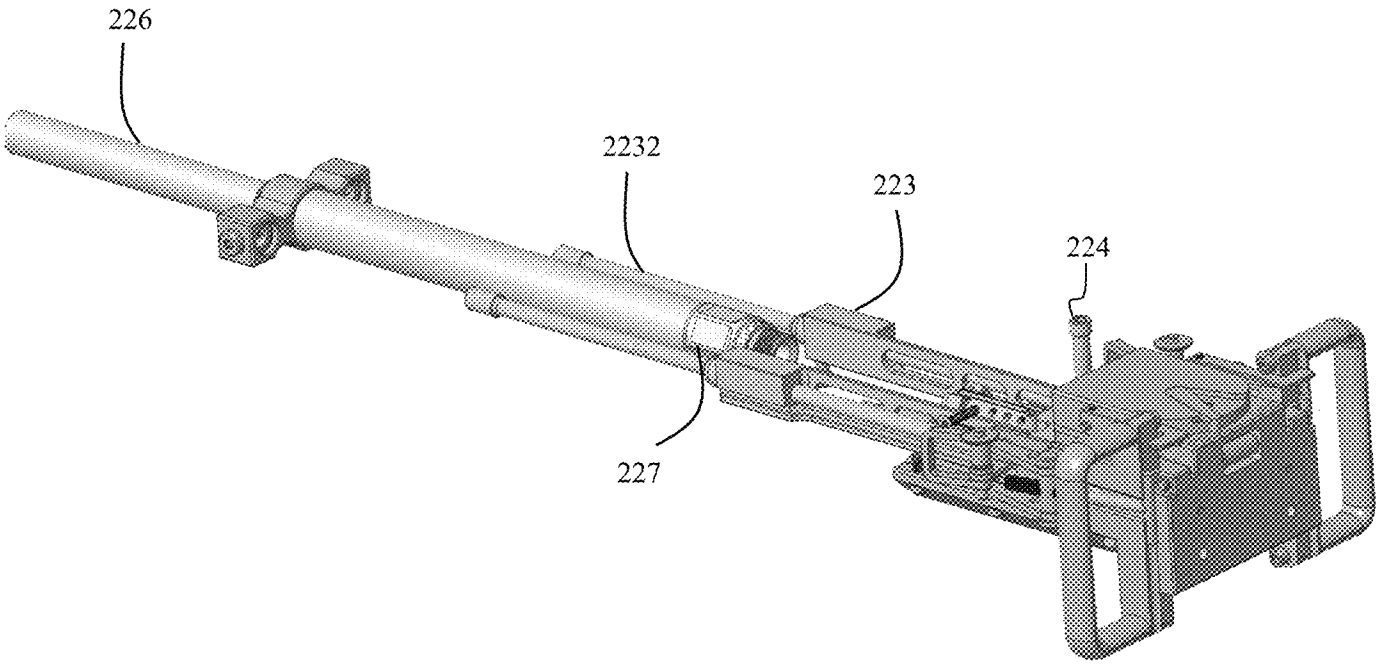
FIG. 25 is an isometric view of internal components of the weapon assembly illustrating a U-shaped bolt, according to an illustrative embodiment.

FIG. 25 is an exploded view of internal components of the weapon assembly illustrating a U-shaped bolt carrier, according to an illustrative embodiment. The weapon assembly 2 further comprises a bolt carrier 223 with an elongated U-shape. The elongated U-shape of the bolt carrier 223 helps actively impart air flow over the surface of the breech end portion of the barrel 226 during every cycle to help keep breech end operating temps lower, help with cook-off limit. When the bolt carrier 223 is in full counter-recoil position, the legs 2232 of that part extend well past the barrel extension 227 and alongside the barrel 226 on each side.

Figure 26:
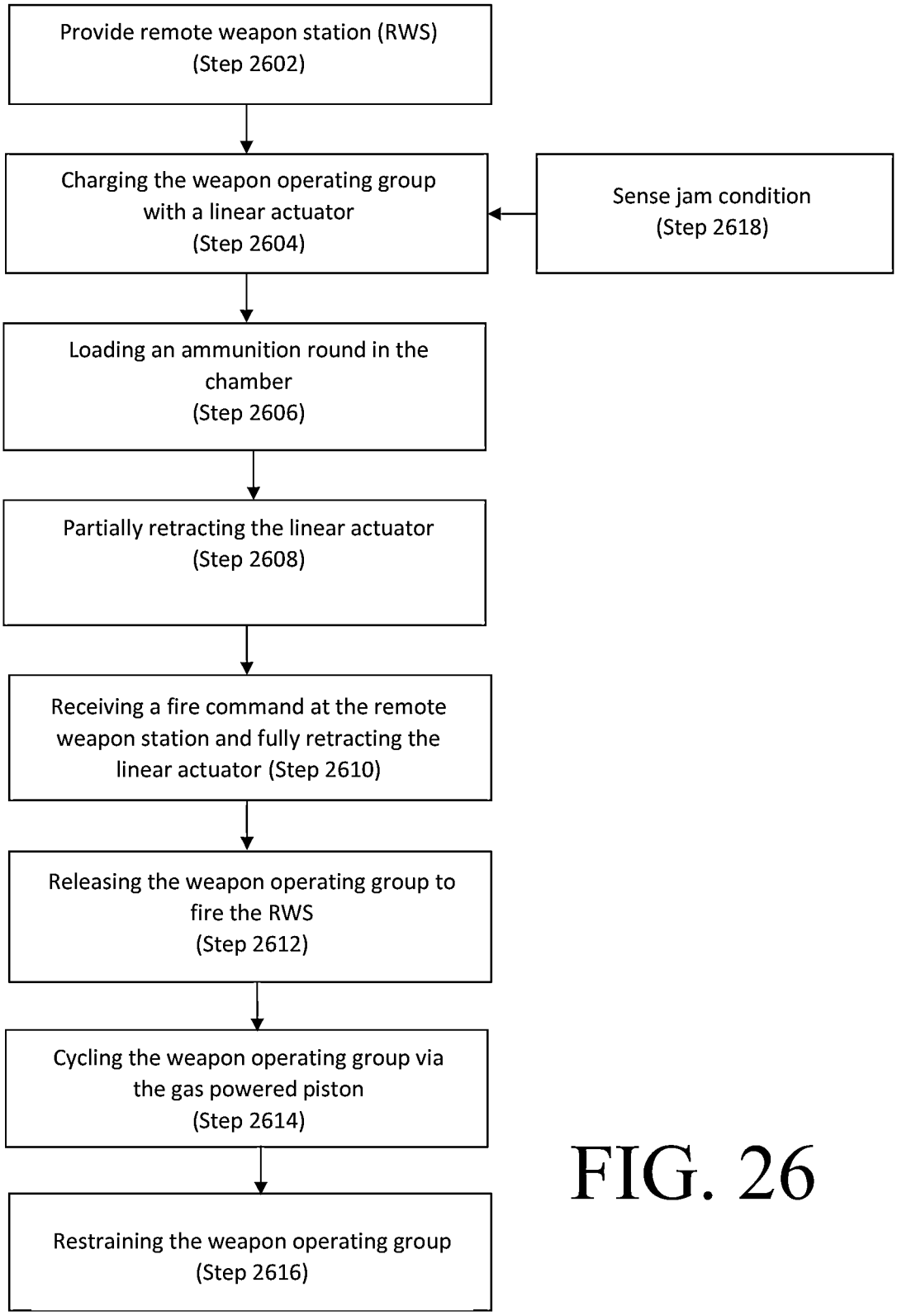
FIG. 26 is a flowchart illustrating a method for operating a hybrid operating group of a remote weapon station for an unmanned vehicle, according to an illustrative embodiment.

FIG. 26 is a flowchart illustrating a method for operating a hybrid operating group of a remote weapon station for an unmanned vehicle, according to an illustrative embodiment.

In step 2602, the RWS is provided.

In step 2604, the weapon operating group is charged rearward by the linear actuators to initially charge the weapon assembly. The charging handle of the weapon operating group is engaged by the connecting member of the linear actuators and translated rearward until restrained by the sear.

In step 2606, the movement of the operating group loads an ammunition round in the chamber for firing.

In step 2608, the linear actuator is partially retracted thereby serving as a physical safety by preventing the weapon operating group from moving forward and firing the ammunition round.

In step 2610, a fire command is received at the RWS and the linear actuators are fully retracted.

In step 2612, nearly instantaneously the weapon operating group is released from the charged position at the sear by the solenoid. The weapon operating group travels forward and strikes the primer of the ammunition round thereby firing the round.

In step 2614, the weapon operating group is cycled via the gas powered piston.

In step 2616, the weapon operating group is restrained in the charged position by the sear.

In step 2618, upon sensing a jam condition, the weapon operating group is charged by the linear actuators to clear the jam.

While the invention has been described with reference to certain embodiments, numerous changes, alterations and modifications to the described embodiments are possible without departing from the spirit and scope of the invention as defined in the appended claims, and equivalents thereof.

The invention claimed is:

1. A remote weapon station for use with an unmanned vehicle, the remote weapon station comprising:

a weapon assembly further comprising a weapon operating group;

an active cradle assembly for receiving the weapon assembly;

a multi-axis gimbal mounted to the unmanned vehicle for supporting and positioning the active cradle to controllably direct fire;

an ammunition magazine mounted on the multi-axis gimbal;

wherein the weapon assembly is not functional when the weapon assembly is separated from the active cradle assembly; and wherein the weapon assembly further comprises a post extending from an interior of the weapon assembly to an exterior of the weapon assembly and biased by a spring to protrude from the exterior of the weapon assembly, said post sized and dimensioned to mate with a corresponding cavity on the active cradle assembly when the weapon assembly is mounted on the active cradle assembly and wherein when the weapon assembly is not mounted on the active cradle assembly, the post is positioned within the weapon assembly such that the post intrudes into the path of the weapon operating group thereby impeding operation of the weapon operating group.

2. The remote weapon station of claim 1 wherein the active cradle assembly comprises ammunition handling components such that separation of the weapon assembly from the active cradle assembly separates the weapon operating group from the ammunition handling components.

3. The remote weapon station of claim 2 wherein the active cradle assembly comprises a remote charging assembly which interfaces with the weapon operating group to charge the weapon operating group and a dual feeder assembly for selectively feeding ammunition from the ammunition magazine into the weapon operating group.

4. The remote weapon station of claim 1 wherein when the weapon assembly is mounted on the active cradle assembly, the post is positioned within the weapon assembly such that the post does not intrude into the path of the weapon operating group.

5. The remote weapon station of claim 4 wherein mounting of the weapon assembly on the active cradle assembly inserts the post further within the weapon assembly such that a head of the post is aligned with a cut-out in the weapon operating group.

6. A remote weapon station for use with an unmanned vehicle, the remote weapon station comprising:

a weapon assembly further comprising a weapon operating group and a post extending from an interior of the weapon assembly to an exterior of the weapon assembly and biased by a spring to protrude from the exterior of the weapon assembly, said post sized and dimensioned to mate with a corresponding cavity on an active cradle assembly when the weapon assembly is mounted on the active cradle assembly;

an active cradle assembly for receiving the weapon assembly and further comprising a remote charging assembly which interfaces with the weapon operating group to charge the weapon operating group and a dual feeder assembly for selectively feeding ammunition from an ammunition magazine into the weapon operating group, and a recoil mount for receiving the weapon assembly and further comprising a cavity sized and dimensioned to receive a portion of the post;

a multi-axis gimbal mounted to the unmanned vehicle for supporting and positioning the active cradle to controllably direct fire;

an ammunition magazine mounted on the multi-axis gimbal;

wherein separation of the weapon assembly from the active cradle assembly also separates the weapon operating group from ammunition handling components; and wherein when the weapon assembly is not mounted on the active cradle assembly, the post is positioned such that the post intrudes into the path of the weapon operating group thereby impeding operation of the weapon operating group and when the weapon assembly is mounted on the active cradle assembly, the post is positioned further within the weapon assembly such that a head is aligned with a cut-out in the weapon operating group.

* * * * *